US010006602B2

(12) United States Patent
Abe

(10) Patent No.: US 10,006,602 B2
(45) Date of Patent: Jun. 26, 2018

(54) LAMP FOR VEHICLES

(71) Applicant: ICHIKOH INDUSTRIES, LTD., Isehara-shi, Kanagawa-ken (JP)

(72) Inventor: Toshiya Abe, Isehara (JP)

(73) Assignee: ICHIKOH INDUSTRIES, LTD., Isehara-Shi (JP)

( * ) Notice: Subject to any disclaimer, the term of this patent is extended or adjusted under 35 U.S.C. 154(b) by 0 days. days.

(21) Appl. No.: 14/891,486

(22) PCT Filed: May 16, 2014

(86) PCT No.: PCT/JP2014/063045

§ 371 (c)(1),
(2) Date: Nov. 16, 2015

(87) PCT Pub. No.: WO2014/185511

PCT Pub. Date: Nov. 20, 2014

(65) Prior Publication Data

US 2016/0097504 A1 Apr. 7, 2016

(30) Foreign Application Priority Data

May 17, 2013 (JP) ..... 2013-105350
May 17, 2013 (JP) ..... 2013-105351

(51) Int. Cl.
*F21V 1/00* (2006.01)
*F21S 8/10* (2006.01)
*F21Y 115/10* (2016.01)

(52) U.S. Cl.
CPC ..... *F21S 48/1258* (2013.01); *F21S 48/1104* (2013.01); *F21S 48/1154* (2013.01); *F21S 48/1216* (2013.01); *F21Y 2115/10* (2016.08)

(58) Field of Classification Search
CPC ..... F21S 48/1258; F21S 48/1104; F21S 48/1154; F21S 48/1216; F21Y 2101/00
(Continued)

(56) References Cited

U.S. PATENT DOCUMENTS 4,797,790 A 1/1989 Brodling et al.
6,639,741 B2 * 10/2003 Wagner ..... F21S 48/155 359/819

(Continued)

FOREIGN PATENT DOCUMENTS

CN 1670426 A 9/2005
DE 11 55 405 B 10/1963

(Continued)

OTHER PUBLICATIONS

Japanese Office Action dated Jan. 17, 2017 as issued in corresponding Japanese Application No. 2013-105350 and its English translation thereof.

(Continued)

*Primary Examiner* — Elmito Breval
*Assistant Examiner* — Jessica M Apenteng
(74) *Attorney, Agent, or Firm* — Foley & Lardner LLP

(57) ABSTRACT

The present invention comprises a semiconductor-type light source, a lens, a lens holder, and a heat sink member. Positioning sections are provided in the lens and the lens holder, respectively. The positioning section in the lens holder comprises a pressing section and a positioning surface. The positioning section in the lens comprises a protrusion-receiving section and a positioning protrusion section. As a result, the present invention is capable of accurately positioning the lens, relative to the lens holder, in the standard optical axis direction of the lens.

7 Claims, 16 Drawing Sheets

(58) Field of Classification Search
USPC ..... 362/509
See application file for complete search history.

(56) References Cited

U.S. PATENT DOCUMENTS

| | | | | |
|---|---|---|---|---|
| 7,575,495 | B2 | 8/2009 | Yamazaki et al. | |
| 2003/0223245 | A1* | 12/2003 | Abe | B60Q 1/0683 362/523 |
| 2008/0253000 | A1* | 10/2008 | Matsunaga | B29C 65/16 359/819 |
| 2014/0009934 | A1* | 1/2014 | Huang | F21V 5/04 362/235 |

FOREIGN PATENT DOCUMENTS

| | | | |
|---|---|---|---|
| EP | 0 936 402 | A1 | 8/1999 |
| FR | 2332887 | A1 | 6/1977 |
| FR | 2798451 | A1 | 3/2001 |
| JP | 61-284001 | A | 12/1986 |
| JP | 02-068801 | A | 3/1990 |
| JP | H08-222014 | A | 8/1996 |
| JP | 3174992 | B2 | 6/2001 |
| JP | 2012-119285 | A | 6/2012 |
| WO | WO-2013/008400 | A1 | 1/2013 |

OTHER PUBLICATIONS

Japanese Office Action dated Jan. 17, 2017 as issued in corresponding Japanese Application No. 2013-105351 and its English translation thereof.

* cited by examiner

LAMP FOR VEHICLES

TECHNICAL FIELD

The present invention relates to a lamp for vehicles. In particular, the present invention relates to a lamp for vehicles, which is capable of accurately positioning a lens in a reference optical axis direction with respect to a lens holder.

BACKGROUND ART

Conventionally, a lamp for vehicles of such type is conventionally known (for example, Patent Literature 1). Hereinafter, a conventional lamp for vehicles will be described. The conventional lamp for vehicles is provided with a lens, a lens holder, a heat sink, and an LED light source. A plugging piece and an engagingly locking claw are formed at a peripheral edge of the lens; a plugging hole, an engagingly locking hole, and a positioning protrusion is formed in the lens holder; the plugging piece is plugged into the plugging hole; and the engagingly locking claw is engagingly locked to the engagingly locking hole. The lens is abutted against the positioning protrusion, and the lens is accurately positioned in a longitudinal direction with respect to the lens holder.

CITATION LIST

Patent Literature

Patent Literature 1: Japanese Unexamined Patent Application Publication No. 2012-119285

SUMMARY OF THE INVENTION

Problems to be Solved by the Invention

However, in so far as the conventional lamp for vehicles is concerned, a lens is abutted against a positioning protrusion, and the lens is accurately positioned in a longitudinal direction with respect to a lens holder. Thus, due to a dimensional tolerance of the lens or the positioning protrusion, there may be a case in which the lens cannot be accurately positioned in the longitudinal direction with respect to the lens holder.

A problem to be solved by the present invention is that, in the conventional lamp for vehicles, there may be a case in which the lens cannot be accurately positioned in the longitudinal direction with respect to the lens holder.

Means for Solving the Problem

A lamp for vehicles according to first aspect of the present invention comprising: a light source; a lens to emit light from the light source to an outside; a lens holder to hold the lens; and a mounting member to which the light source and the lens holder are mounted, wherein, at the lens and the lens holder, positioning sections to position the lens in a reference optical axis direction of the lens are respectively provided, wherein the positioning sections of the lens holder each are composed of: a pressing section to press the lens in one direction of the reference optical axis direction; and a positioning surface which is provided to be orthogonal to or substantially orthogonal to the reference optical axis direction, and wherein the positioning sections of the lens each are composed of: a receiving section to receive a pressing force of the pressing section; and a positioning abutment section to abut against the positioning surface by way of the pressing force of the pressing section that is received at the receiving section.

The lamp for vehicles according to second aspect of the invention, wherein the lens is composed of: a lens section; and a flange section which is provided at a peripheral edge part of the lens section, wherein the lens holder is composed of: a holding cylindrical section; and an opening section which is provided at an end of the holding cylindrical section, and in which the lens section is disposed at a center part, wherein the pressing section is provided at the holding cylindrical section, wherein the positioning surface is provided at the holding edge part so as to oppose to the pressing section, wherein the positioning abutment section is provided on a surface which opposes to the positioning surface, of the flange section, wherein the receiving section is provided on a surface which opposes to the pressing section, of the flange section, and in a range in which the pressing force of the pressing section is conveyed to the positioning abutment section.

The lamp for vehicles according to third aspect of the invention, wherein the receiving section is provided at an edge side of the flange section with respect to the positioning abutment section.

The lamp for vehicles according to fourth aspect of the invention, wherein the positioning abutment section forms a shape of a protrusion section to abut against the positioning surface on a minute plane, and wherein the receiving section forms a shape of a protrusion section to receive the pressing force of the pressing section in a linear shape or in a substantially linear shape along an edge of the flange section.

A lamp for vehicles according to a fifth aspect of the present invention, comprising: a light source; a lens to emit light from the light source to an outside; a lens holder to hold the lens; and a mounting member to which the light source and the lens holder are mounted, wherein, at the lens and the lens holder, a positioning section to determine a position of the lens and a gap narrowing section to narrow a gap of the positioning section are respectively provided, wherein the gap narrowing section is composed of: a receiving surface; and a protrusion to come into elastic contact with the receiving surface and narrow the gap of the positioning section, and wherein an opening section is provided in a close vicinity of the protrusion.

The lamp for vehicles according to a sixth aspect of the invention, wherein the positioning section comprises an XY-positioning section and a rotation positioning section, and wherein the gap narrowing section has at least one set of the receiving surface and the protrusion, and is disposed inside with respect to the XY-positioning section and the rotation positioning section.

The lamp for vehicles according to a seventh aspect of the invention, wherein the positioning section is provided at a respective one of a lower part of the lens and a lower part of the lens holder, and wherein the gap narrowing section is provided at a respective one of an upper part of the lens and an upper part of the lens holder.

Effect of the Invention

According to a lamp for vehicles, of the present invention, a pressing section of a lens holder presses a lens in one direction of a reference optical axis direction via a receiving-protrusion section of the lens, and the positioning protrusion section of the lens abuts against a positioning surface which is orthogonal to or substantially orthogonal to the reference optical axis direction by way of a pressing force of the pressing section that is received at the receiving-protrusion section. That is, the receiving-protrusion section and the positioning protrusion section of the lens are sandwiched between the pressing section and the positioning surface of the lens holder and then are fixed by way of the pressing force of the pressing section. Thus, the lens can be accurately positioned in the reference optical axis direction with respect to the lens holder.

According to the lamp for vehicles, of the present invention, a protrusion comes into elastic contact with a receiving surface and then narrows a gap between a protrusion section and a contact surface. Thus, the lens can be accurately positioned at the lens holder. More specifically, the present invention is provided with a lens, a lens holder, and a heat sink member. At the lens and the lens holder, a positioning section and a gap narrowing section are respectively provided. The gap narrowing section of the lens holder is composed of a protrusion in which slits are provided at both sides. The gap narrowing section of the lens is composed of a receiving surface. As a result, the present invention is capable of accurately positioning the lens at the lens holder.

MODE FOR CARRYING OUT THE INVENTION

Hereinafter, an embodiment (example) and modification examples of a lamp for vehicles, according to the present invention, will be described in detail with reference to the drawings. It is to be noted that the present invention is limited by the embodiment. In the specification, the front, rear, top, bottom, left, and right are respectively equivalent to the front, rear, top, bottom, left, and right when the lamp for vehicles, according to the present invention, is mounted on a vehicle.

Description of Configuration of Embodiment

Figure 1:
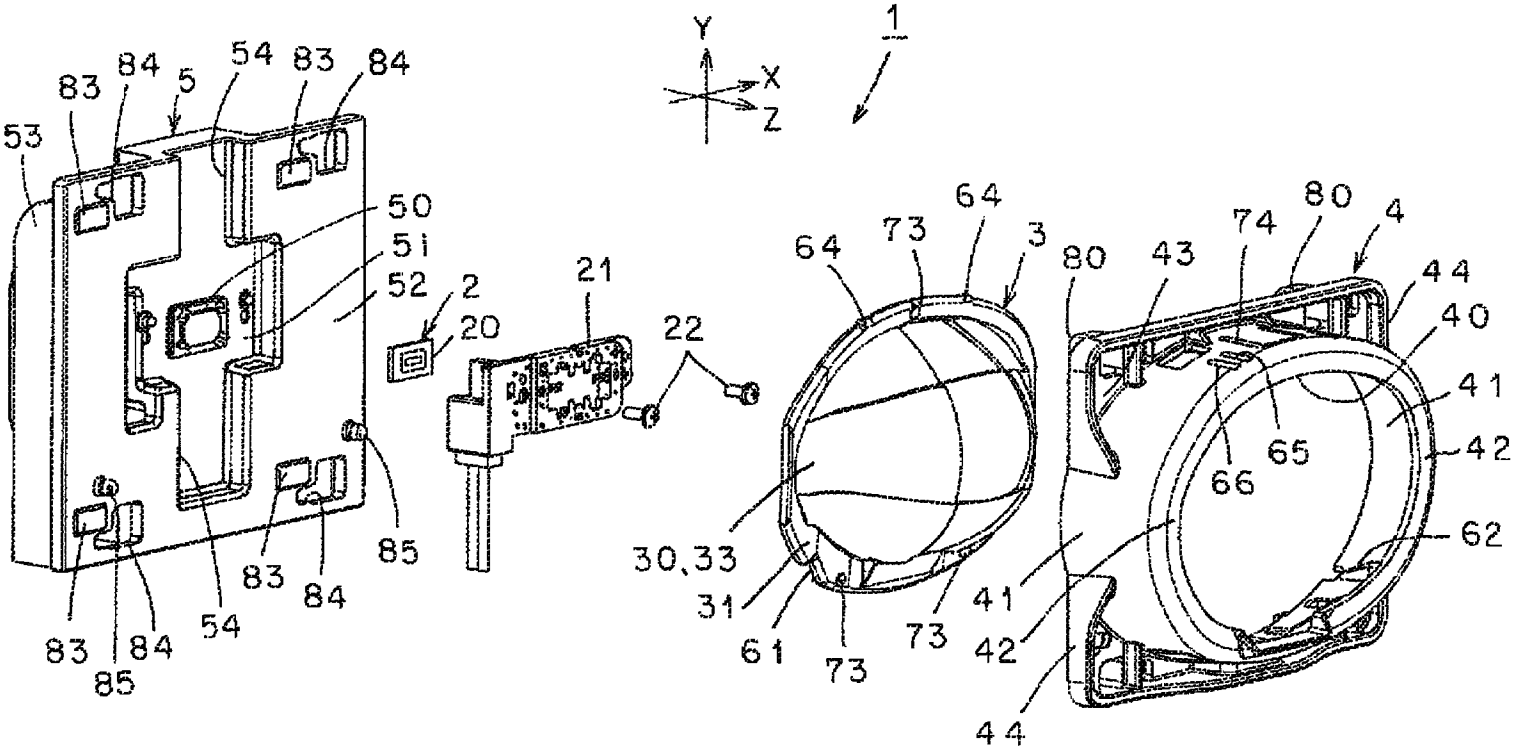
FIG. 1 is a perspective view which is seen from a front face (surface and front face) side oblique top of an exploded state of a lamp unit showing an embodiment of a lamp for vehicles, according to the present invention.

FIG. 1 to FIG. 10 each show an embodiment of the lamp for vehicles, according to the present invention. Hereinafter, a configuration of the lamp for vehicles, according to the embodiment, will be described. In FIG. 1, reference numeral 1 designates the lamp for vehicles, according to the embodiment (for example, a vehicular headlamp such as a headlamp). The lamp 1 for vehicles is mounted to each of the left and right ends of a front part of a vehicle.

(Description of Lamp 1 for Vehicles)

The lamp 1 for vehicles, as shown in FIG. 1, is provided with: a lamp housing (not shown); a lamp lens (not shown): a semiconductor-type light source 2 as a light source; a lens 3; a lens holder 4; a mounting member compatible with a heat sink member (hereinafter, referred to as a "heat sink member") 5.

(Description of Lamp Unit Formed by Constituent Elements 2, 3, 4, 5)

The semiconductor-type light source 2, the lens 3, the lens holder 4, and the heat sink member 5 constitute a lamp unit. The lamp housing and the lamp lens define a lamp room (not shown). The lamp unit formed by the constituent elements 2, 3, 4, 5 is disposed in the lamp room, and is mounted to the lamp housing via an optical axis adjustment mechanism for vertical direction (not shown) and an optical axis adjustment mechanism for transverse direction (not shown).

(Description of Semiconductor-Type Light Source 2)

The semiconductor-type light source 2, as shown in FIG. 1, in this example, is a self-emission semiconductor-type light source such a an LED, an OEL, or an OLED, for example. The semiconductor-type light source 2 is composed of a light emitting chip (an LED chip) having a light emission surface; a package (an LED package), having sealed the light emitting chip with a sealing resin member therein; and a board 20 having implemented the package thereon. The semiconductor-type light source 2 is positioned and mounted to a light source mounting section 50 of the heat sink member 5 via a light source holder 21.

The light emission surface of the light emitting chip is oriented to a front side of a reference optical axis (a reference axis) of the lens 3. A center of the light emission surface of the light emitting chip is positioned at or near a reference focal point of the lens 3, and is positioned on or near a reference optical axis Z of the lens 3.

In FIG. 1, axes X, Y, Z constitute an orthogonal coordinate (an X-Y-Z orthogonal coordinate system). The X-axis is a horizontal axis in a transverse direction passing through the center of the light emission surface of the light emitting chip, and in the embodiment, the outside of the vehicle, that is, the left side is in a positive (+) direction, and the right side is in a negative (−) direction. Also, the Y-axis is a vertical axis in a vertical direction passing through the center of the light emission surface of the light emitting chip, and in the embodiment, the upper side is in a positive (+) direction, and the lower side is in a negative (−) direction. Further, the X-axis is a normal line (perpendicular line) passing through the center of the light emission surface of the light emitting chip, that is, is an axis in a longitudinal direction which is orthogonal to the X-axis and the Y-axis, and in the embodiment, the front side is a positive (+) direction, and the rear side is in a negative (−) direction. The reference optical axis Z of the lens 3 and the Z-axis are coincident with or substantially coincident with each other.

The light source holder 21 is positioned and mounted to a light source holder mounting section 51 of the heat sink member 5 by way of a screw 22. At the light source holder 21, a holder section to hold the semiconductor-type light source 2 on the heat sink member 5; and a terminal, a circuit, and a connector to supply power to the semiconductor-type light source 2 are respectively provided at their appropriate positions.

(Description of Lens 3)

The lens 3, as shown FIG. 1 to FIG. 4, FIG. 6, and FIG. 7, is composed of a lens section 30, an auxiliary lens section (an additional lens section); and a flange section 31. The shape in the front view of the lens section 30 forms a noncircular shape. That is, the lens 3 is a uniquely shaped lens. The lens 3 is composed of a resin member.

The lens 3 is positioned and held on the lens holder 4. The lens 3 is positioned and mounted to the heat sink member 5 via the lens holder 4. The lens 3 transmits light from the semiconductor-type light source 2 through the lens section 30 and the auxiliary lens section and then is emitted to the outside.

The lens section 30 is composed of: an incidence surface 32 of a rear side of the lens 3; and an emission surface 33 of a front side of the lens 3. The incidence surface 32 forms a convex curved face which protrudes to the semiconductor-type light source 2 side, a concave curved face which is recessed to an opposite side to the semiconductor-type light source 2, or a plane. The incidence surface 32 is composed of a free curved face; a quadratic curved face; a composite quadratic curved face; a plane; a surface of a combination thereof: or a plane. The emission surface 33 forms a convex curved face which protrudes to the opposite side to the semiconductor-type light source 2. The emission surface 33 is composed of a free curved face; a quadratic curved face; a composite quadratic curved face; or a surface of a combination thereof.

The auxiliary lens section is integrally provided at a lower center part of a peripheral edge part of the lens section 30. The auxiliary lens section is composed of an incidence surface, a reflection surface, and an emission surface.

The flange section 31 is integrally provided at (all or part) of a respective one of the peripheral edge parts of the lens section 30 and the auxiliary lens section. A rear face of the flange section 31 is made of a free curved face or a plane which is substantially similar to the incidence surface 32. A front face of the flange section 31 is made of a free curved face which is substantially similar to the emission surface 33. A shape in a front view of an edge of the flange section 31 (an edge face and an exterior face) forms a noncircular shape like the shape in the front view of the lens section 30.

(Description of Lens Holder 4)

The lens holder 4 is composed of a resin member having elasticity and a lower thermal conductivity thereof than that of the heat sink member 5 (having a large thermal resistance), for example, a resin member. The lens holder 4, as shown in FIG. 1, FIG. 2, and FIG. 5 to FIG. 7, is composed of a cylindrical structure having an opening section 40 in which the lens section 30 is to be disposed at a center part. The lens holder 4 is composed of a holding cylindrical section 41, a holding edge part 42, a mounting plate section 43, and a reinforcement rib section 44.

The lens holder 4 positions and holds the lens 3. The lens holder 4 is positioned and mounted to the heat sink member 5. As a result, the lens 3 is positioned and mounted to the heat sink member 5 via the lens holder 4.

The holding cylindrical section 41 forms a cylindrical shape. A shape in a front view of the holding cylindrical section 41 forms a noncircular shape like the shape in the front view of the lens 3. An inner circumferential face of the holding cylindrical section 41 forms a shape which is slightly larger than an outer circumferential face of an edge of the flange section 31 of the lens 3.

The holding edge part 42 forms a flange shape, and is integrally provided inside of the holding cylindrical section 41 from one end (a front side edge) of the holding cylindrical section 41. At a center part of the holding edge part 42, the opening section 40 is provided. A shape in a front view of the inner circumferential face of the holding edge part 42 (that is, an edge of the opening section 40) forms a noncircular shape like the shape in the front view of the lens section 30 of the lens 3. The inner circumferential face of the holding edge part 42 forms a shape which is slightly smaller than the outer circumferential face of the edge of the flange section 31 of the lens 3 and which is slightly larger than a boundary between the lens section 30 and the flange section 31.

The mounting plate section 43 forms a shape of a plate, and is integrally provided upper outside and lower outside of the holding cylindrical section 41 from an upper part and a lower part of another end (an edge of a rear side) of the holding cylindrical section 41. A shape in a front view of an external shape of the mounting plate section 43 forms a substantial rectangular shape. That is, an intermediate part of both of the left and right edges of the mounting plate section 43 is a part of both of the left and right side parts of the holding cylindrical section 41, and forms a curved shape.

The reinforcement rib section 44 forms a rib shape, and is integrally provided at a front side from four edges of the mounting plate section 43. A shape in a front view of the reinforcement rib section 44 forms a substantially rectangular shape which is substantially similar to the shape in the front view of the external shape of the mounting plate section 43. That is, the reinforce rib section 44 of an upper side forms a U-shape of which lower side opens, and the reinforcement rib section 44 of a lower side forms a U-shape of which an upper side opens.

(Description of Heat Sink Member 5)

The heat sink member 5 is a mounting member to which the semiconductor-type light source 2 and the lens holder 4 are mounted and to which the lens 3 is mounted via the lens holder 4. The heat sink member 5 radiates, to the outside, a heat which is generated at the semiconductor-type light source 2. The heat sink member 5 is made of an aluminum die-cast or a resin member having thermal conductivity, for example. The heat sink member 5, as shown in FIG. 1, is composed of a vertical plate section 52; and a plurality of vertically plate-shaped fin sections 53 which are integrally provided on one face (a rear face) of the vertical plate section 52.

At a center part of a mounting surface (a plane or a substantial plane) of another face (a front face) of the vertical plate section 52 of the heat sink member 5, a substantially cross-shaped recessed part 54 is provided. At a center part of a bottom face of the recessed part 54, the light source mounting section 50 is provided. On the bottom face of the recessed part 54 and at the periphery of the light source mounting section 50, the light source holder mounting section 51 is provided.

(Description of Positioning Section)

At the lens 3 and the lens holder 4, positioning sections are respectively provided. The positioning sections each determine a position of the lens 3 with respect to the lens holder 4. The positioning sections each are composed of an XY-positioning section, a rotation positioning section, and a Z-positioning section.

(Description of XY-Positioning Section)

Figure 2:
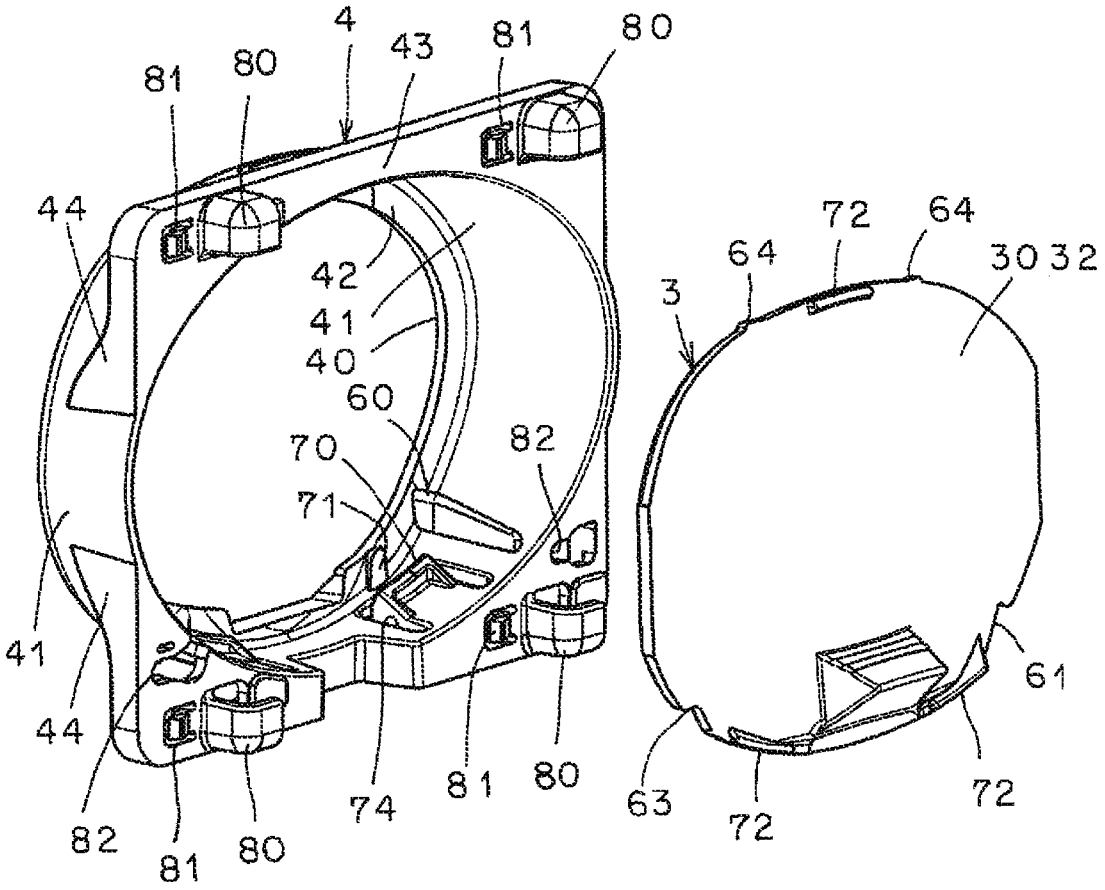
FIG. 2 is an exploded perspective view which is seen from a rear face (back face and rear face) side showing a lens and a lens holder of the lamp unit.
Figure 3:
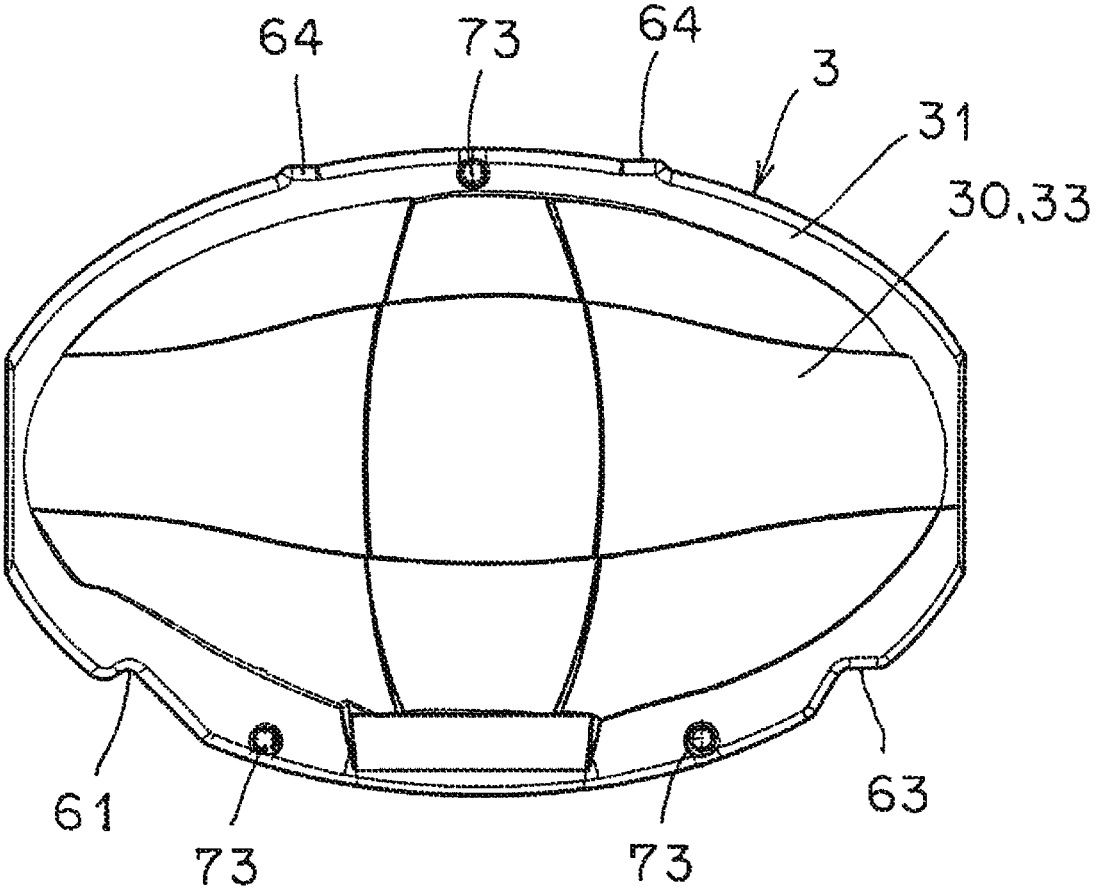
FIG. 3 is a front view showing the lens of the lamp unit.
Figure 4:
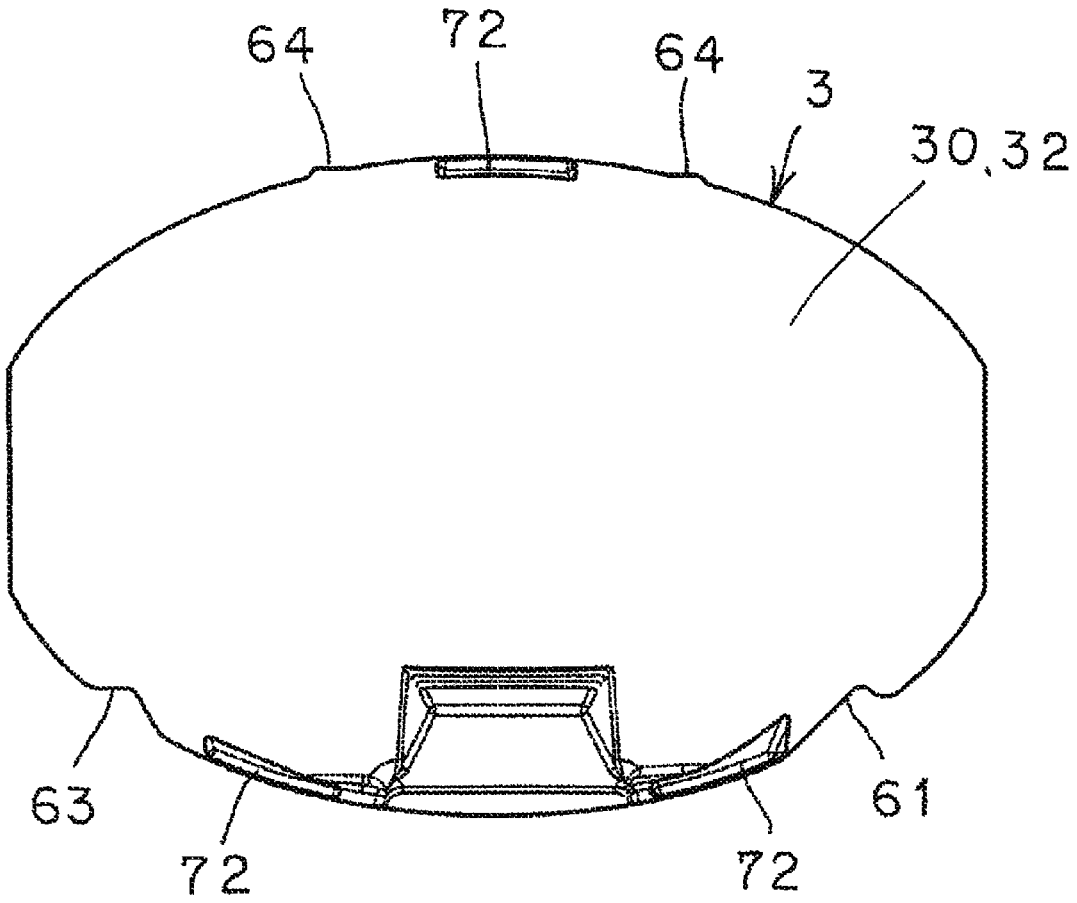
FIG. 4 is a rear view showing the lens of the lamp unit.
Figure 7:
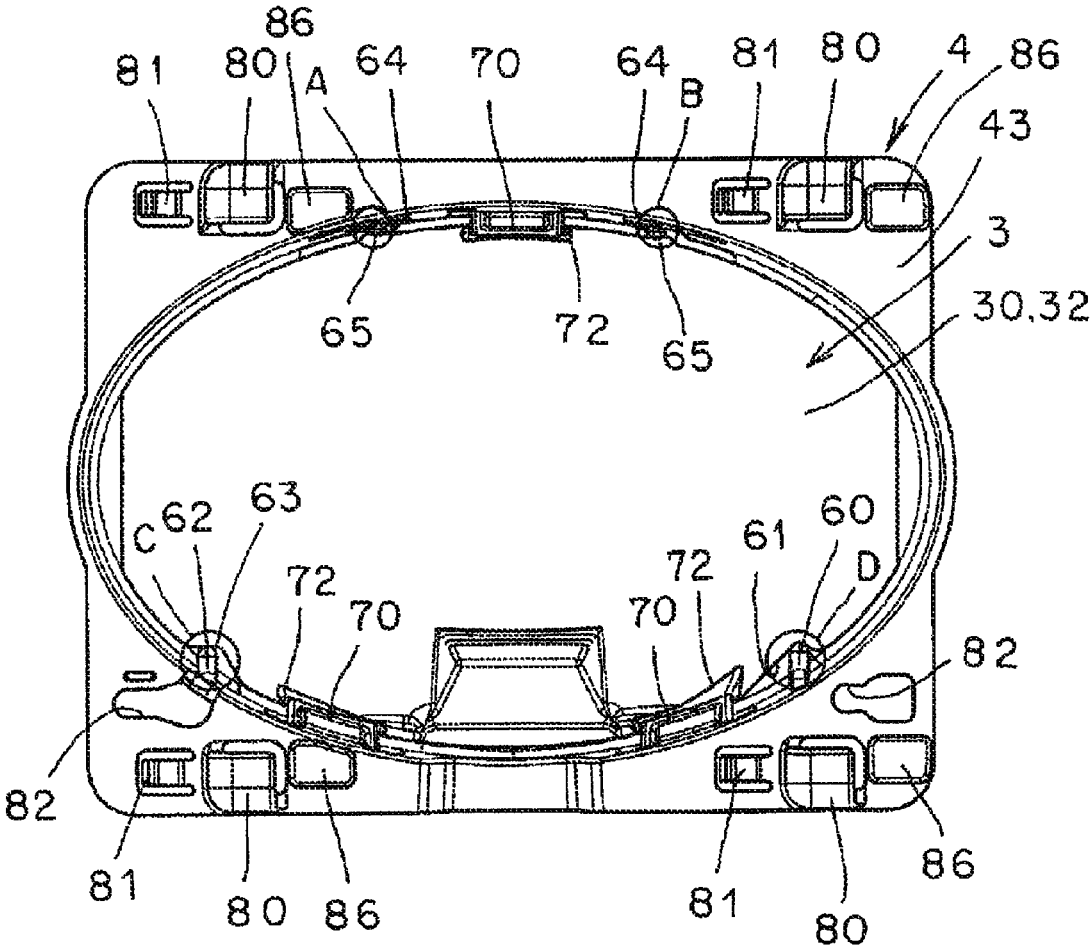
FIG. 7 is a rear view showing an assembled state between the lens and the lens holder of the lamp unit.
Figure 14:
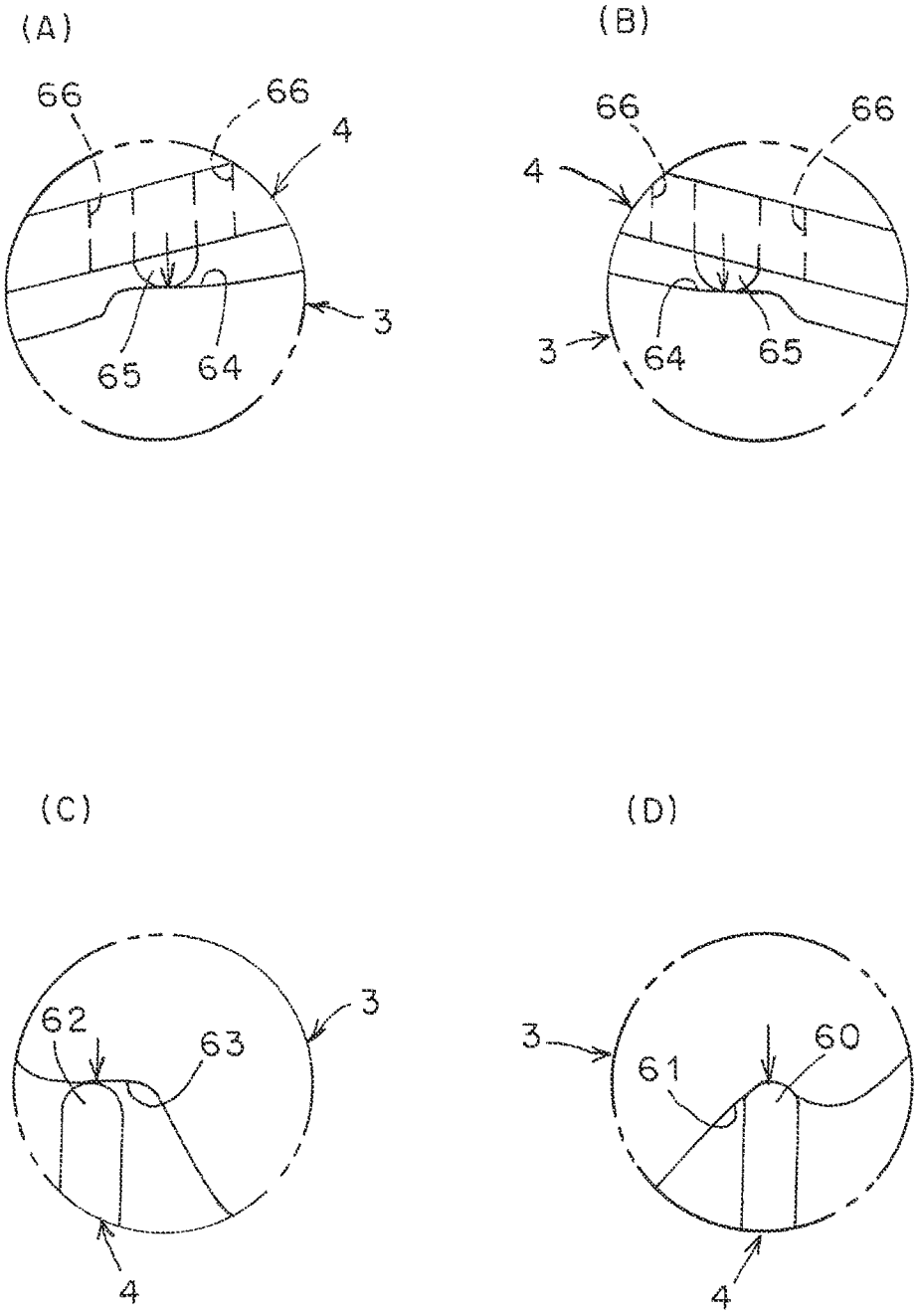
FIG. 14 is a partially enlarged rear view showing an assembled state between the lens and the lens holder of the lamp unit.
Figure 15:
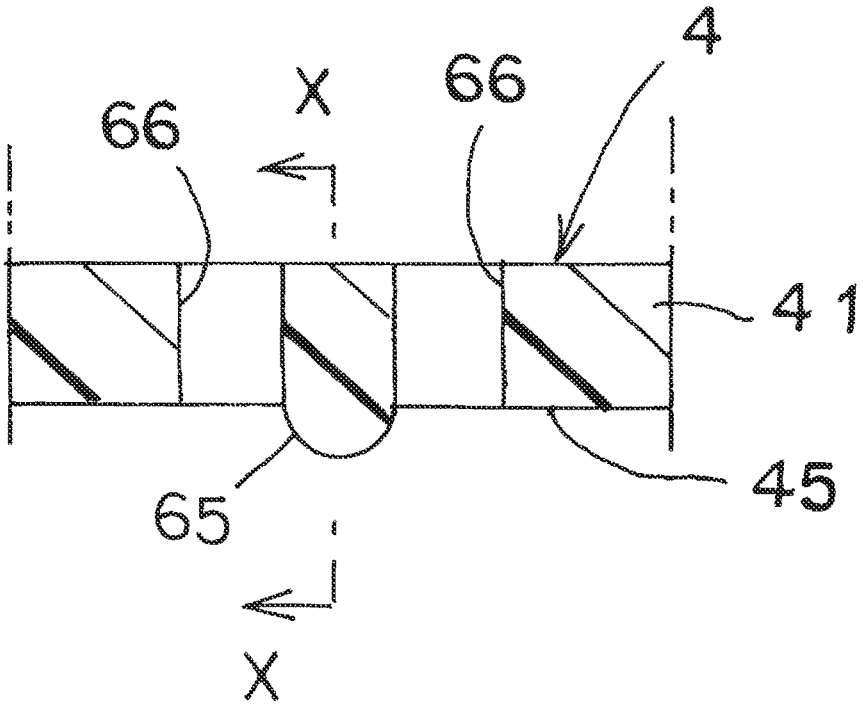
FIG. 15 is a partially enlarged sectional view showing a protrusion of a gap narrowing section.
Figure 16:
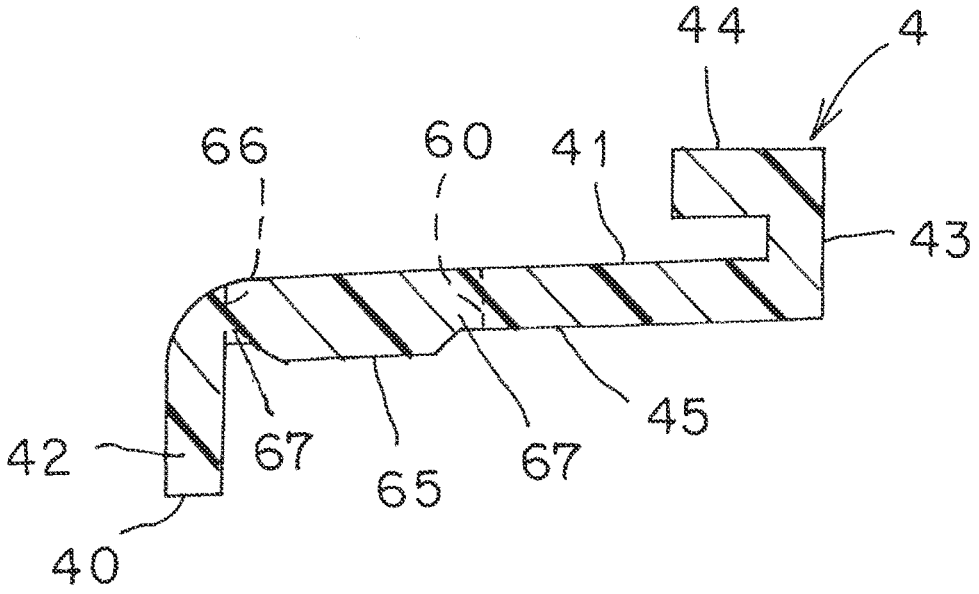
FIG. 16 is a partially enlarged sectional view showing the protrusion of the gap narrowing section (a view corresponding to the cross section taken along the line X-X in FIG. 15).

The XY-positioning section determines positions of the X-axis direction (X-axis direction) and the Y-axis direction (Y-axis direction) of the lens 3. The XY-positioning section, as shown in FIG. 2, FIG. 7, and FIG. 14 (D), is composed of a protrusion section 60 which protrudes in the Y-axis direction and the Z-axis direction; and a contact surface 61 which comes into contact with two parts (two points or two straight lines) of a side face of the protrusion section 60. It is to be noted that FIG. 14 (D) i an enlarged rear view of part D in FIG. 7.

The protrusion section 60 of the XY-positioning section is provided at a part of the lower right side of the inner circumferential face of the holding cylindrical section 41 of the lens holder 4. It is sufficient if the protrusion section 60 of the XY-positioning section is partially composed of a curved face part at which the contact surface 61 comes into contact with the two parts or the straight line. For example, this protrusion section may be a pin. The contact surface 61 of the XY-positioning section is provided to correspond to the protrusion section 60 at the part of the lower right side of the flange section 31 of the lens 3. The contact surface 61 of the XY-positioning section is made of: two V-planes or one curved face forming a substantial V-shape.

(Description of Rotation Positioning Section)

The rotation positioning section determines a position in a rotation direction on an XY-plane about the XY-positioning section of the lens 3 (about the curved face part of the protrusion section 60). The rotation positioning section, as shown in FIG. 7 and FIG. 14 (C), is composed of a protrusion section 62 which protrudes in the Y-axis direction and the Z-axis direction; and a contact surface 63 which comes into contact with one part of an upper part of the protrusion section 62 (one part or one straight line). It is to be noted that FIG. 14 (C) is an enlarged rear view of part C in FIG. 7.

The protrusion section 62 of the rotation positioning section is provided at a part of the lower right side of the inner circumferential face of the holding cylindrical section 41 of the lens holder 4. It is sufficient if the protrusion section 62 of the rotation positioning section is partially composed of a curved face part at which the contact surface 63 comes into contact with one point or comes into contact the straight line. For example, this protrusion section may be a pin. The contact surface 63 of the rotation positioning section is provided to correspond to the protrusion section 62 at a part of the lower left side of the flange section 31 of the lens 3. The contact surface 63 of the rotation positioning section forms a plane or a curved face.

(Description of Z-Positioning Section)

Figure 8:
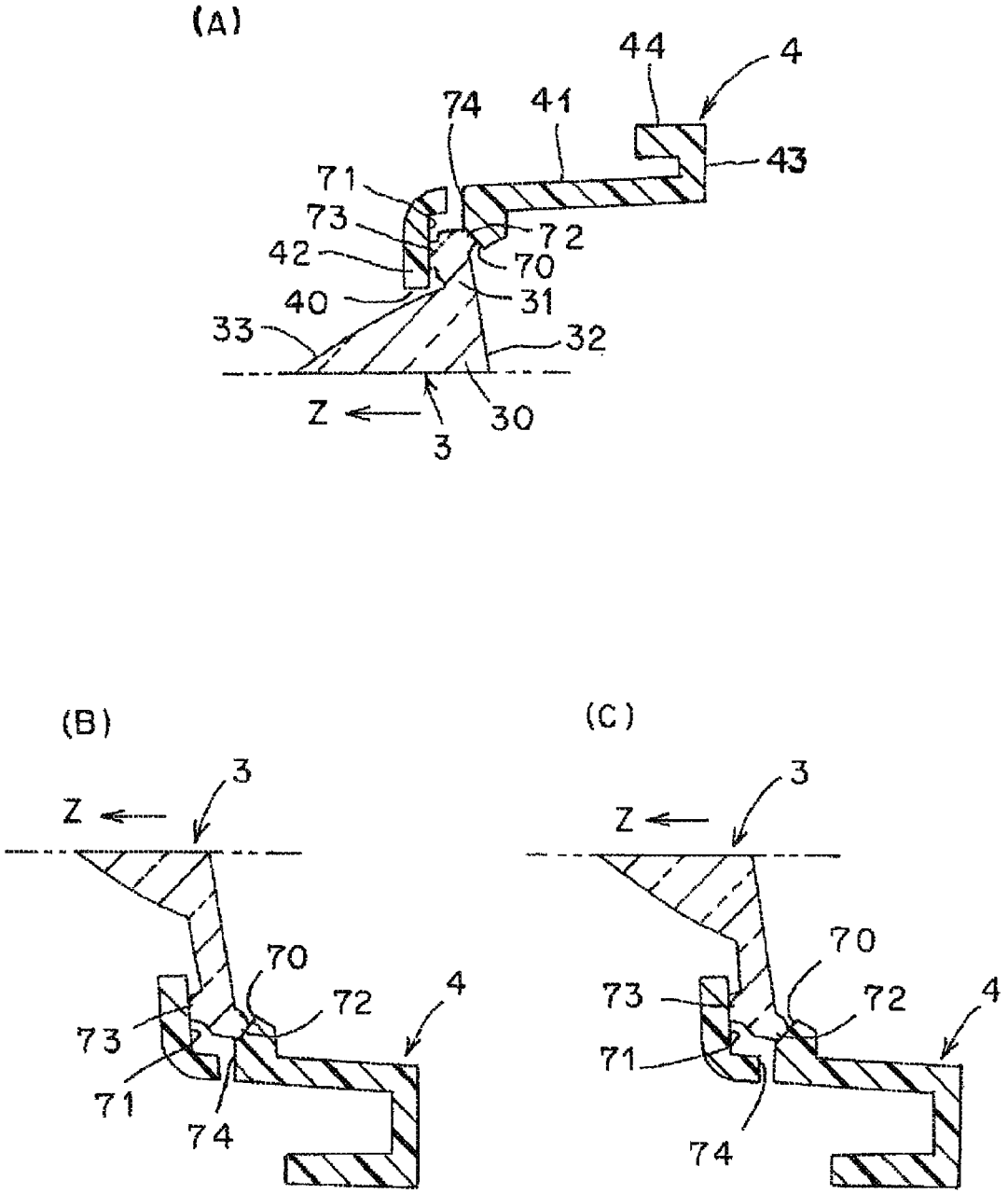
FIG. 8 is a partially enlarged view showing an assembled state between the lens and the lens holder of the lamp unit.
Figure 9:
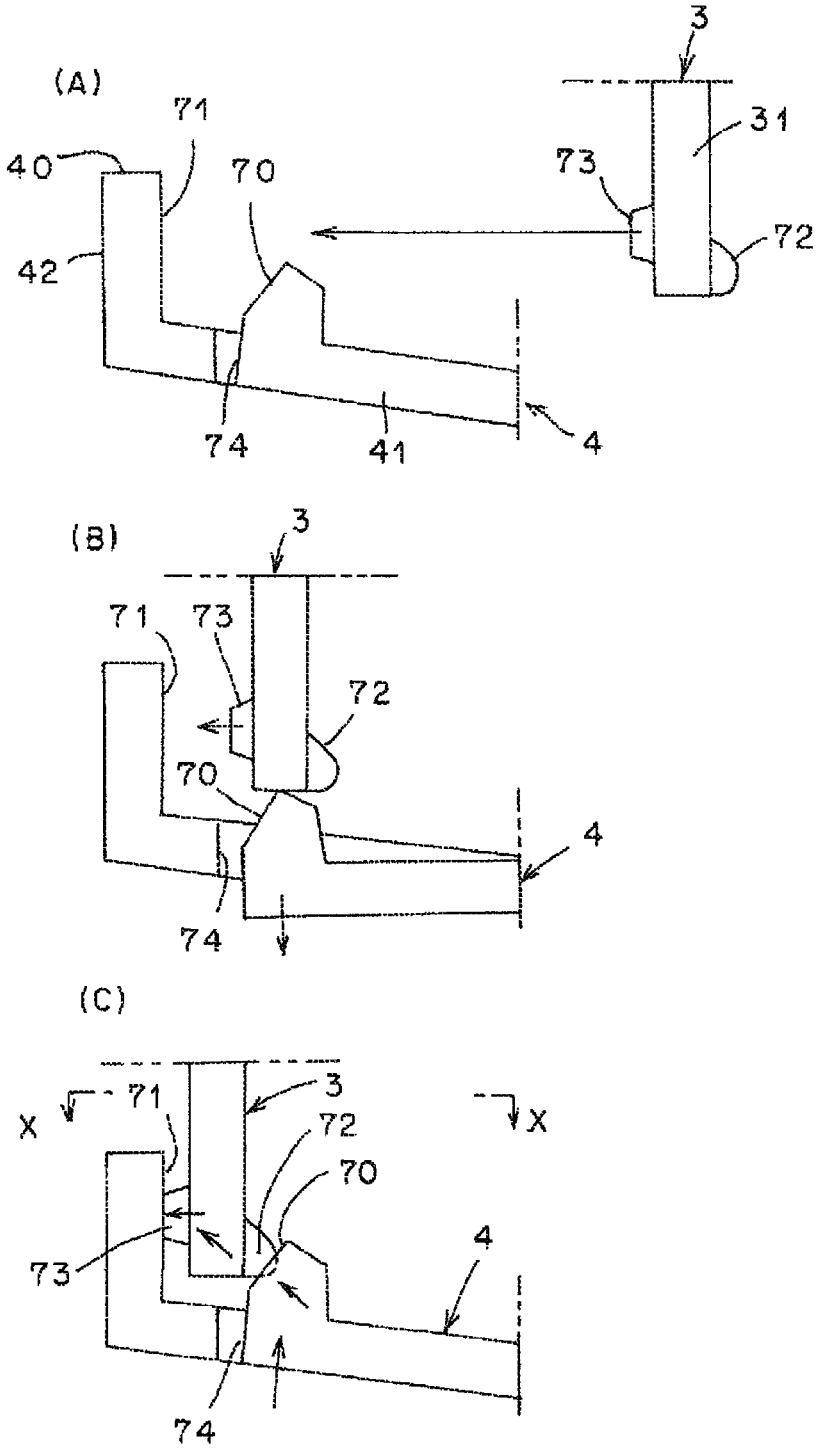
FIG. 9 is a partially enlarged explanatory view showing an assembled state between the lens and the lens holder of the lamp unit.
Figure 10:
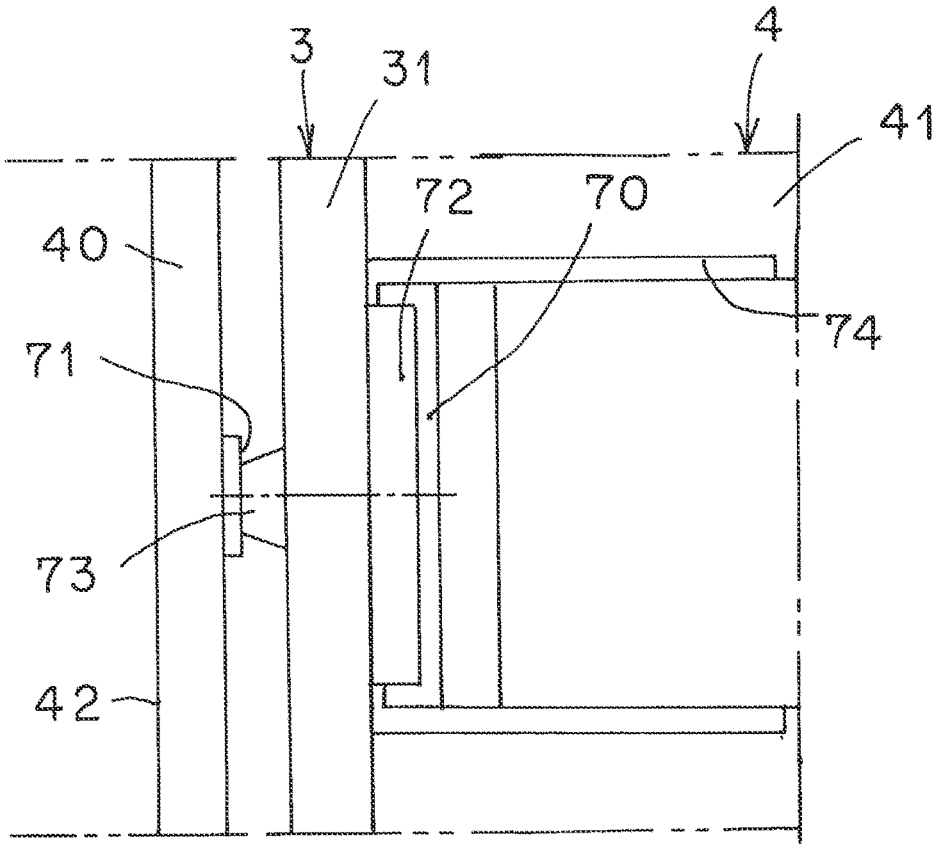
FIG. 10 is a view taken along the line X-X in FIG. 9.

The Z-positioning section determines a position in the Z-axis direction of the lens 3 (in the Z-axis direction of the reference optical axis). The Z-positioning section of the lens holder 4, as shown in FIG. 8 to FIG. 10, is composed of a pressing section 70 and a positioning surface 71. On the other hand, the Z-positioning section of the lens 3, similarly, as shown in FIG. 8 to FIG. 10, is composed of a receiving-protrusion section 72 as a receiving section; and a positioning protrusion section 73 as a positioning abutment section. It is to be noted that FIG. 8(A) is a partially sectional view taken along the line A-A in FIG. 6. FIG. 8(B) is a partially sectional view taken along the line B-B in FIG. 6. FIG. 8(C) is a partially sectional view taken along the line C-C in FIG. 6.

The pressing section 70 is provided protrusively inside of the lens holder 4 at a respective one of three parts, an upper center and both of lower left and right sides of the holding cylindrical section 41 of the lens holder 4. At the both of the left and right sides and a front side of the pressing section 70 (a boundary between the holding cylindrical section 41 and the holding edge part 42), recess-shaped cutouts 74 are provided. As a result, the pressing section 70 has elasticity thereof in a perpendicular direction or in a substantially perpendicular direction with respect to the Z-axis direction of the reference optical axis of the lens 3 (the Z-axis direction). The pressing section 70 presses the lens 3 in one direction (a front direction) of the Z-axis direction of the reference optical axis.

The positioning surface 71 is provided to oppose to the pressing section 70 on a respective one of the interior faces (rear faces) of three parts, an upper center and both of lower left and right sides of the holding edge part 42 of the lens holder 4. The positioning surface 71 is a surface which is orthogonal to or substantially orthogonal to the Z-axis direction of the reference optical axis.

The positioning protrusion section 73 is provided to correspond to a surface which opposes to the positioning surface 71, of the flange section 31 of the lens 3, and to correspond to the positioning surface 71, at a respective one of the upper center and both of the lower left and right sides of the flange section 31. The positioning protrusion section 73 forms a minute conical trapezoidal shape. That is, an apex of the positioning protrusion section 73 is made of a minute plane which is perpendicular to or substantially perpendicular to the reference optical axis Z. As a result, the positioning protrusion section 73 abuts against the positioning surface 71 on the minute plane due to a pressing force of the pressing section 70 that is received on the receiving-protrusion section 72 (refer to the solid arrow in FIG. 9(C)). It is to be noted that a shape of the positioning protrusion section 73 may be a shape other than the conical trapezoidal shape, for example, a columnar shape, or alternatively, may form a hemispheric shape and abut against the positioning surface 71 at a point.

The receiving-protrusion section 72 is provided to correspond to a surface which opposes to the pressing section 70 of the flange section 31 of the lens 3 and the pressing section 70 at a respective one of the three parts, the upper center and both of the lower left and right sides of the flange section 31. The receiving-protrusion section 72 forms a protrusion stripe shape along an edge of the flange section 31. An exterior face of the receiving-protrusion section 72 forms a curved face. As a result, the receiving-protrusion section 72 receives the pressing force of the pressing section 70 in a linear shape or in a substantially linear shape along the edge of the flange section 31.

The receiving-protrusion section 72 is provided in a range in which the pressing force of the pressing section 70 is conveyed to the positioning protrusion section 73. That is, the receiving-protrusion section 72, as shown in FIG. 8 and FIG. 9, is provided along the edge of the flange section 31 at each side about the positioning protrusion section 73. Also, the receiving-protrusion section 72, as shown in FIG. 10, is provided along an edge of the flange section 31 about the positioning protrusion section 73.

The pressing section 70 and the receiving-protrusion section 72, as indicated by the dashed line in FIG. 9(C), are in a positional relationship in which they slightly interfere (slightly overlap) with each other. Thus, a part of the apex of the receiving-protrusion section 72 cuts into a surface of the pressing section 70. It is to be noted that, the cut-in quantity indicated by the dashed line in FIG. 9(C) is illustrated so as to be larger than actual quantity.

Two lower pressing sections, of the three pressing sections 70, the positioning surface 71, the receiving-protrusion section 72, and the positioning protrusion section 73 of the Z-positioning section, are respectively positioned between the protrusion section 60 and the contact surface 61 of the XY-positioning section and between the protrusion section 62 and the contact surface 63 of the rotation positioning section. The three pressing sections 70, the positioning surface 71, the receiving-protrusion section 72, and the positioning protrusion section 73 of the Z-positioning section are respectively positioned at positions which surround a gravity of the lens 3.

(Description of Gap Narrowing Section)

At the lens 3 and the lens holder 4, gap narrowing sections are respectively provided. The gap narrowing sections narrow a gap between the protrusion section 60 and the contact surface 61 of the XY-positioning section and a gap between the protrusion section 62 and the contact surface 63 of the rotation positioning section. That is, the gap narrowing section positions the lens 3 reliably without a backlash at a position which is determined by the XY-positioning section (the position in the X-axis direction and the Y-axis direction) and a position which is determined by the rotation positioning section (the position in the rotation direction on the XY-plane).

The gap narrowing section of the lens 3, as shown in FIG. 2 to FIG. 4 and FIG. 14(A) and FIG. 14(B), is composed of a receiving surface 64. The receiving surface 64 is provided at a respective one of two parts at both of the upper left and right sides of an edge (an edge face) of the flange section 31 of the lens 3. The two receiving surfaces 64 are respectively made of planes which are parallel to or substantially parallel to each other with respect to the X-axis. The two receiving surfaces 64 are disposed at both of the left and right sides of the receiving-protrusion section 72 and the positioning protrusion section 73 of the Z-positioning section of the top lens 3. It is to be noted that FIG. 14(A) is an enlarged rear view of part A in FIG. 7. FIG. 14(B) is an enlarge rear view of part B in FIG. 7.

The gap narrowing section of the lens holder 4, as shown in FIG. 5, FIG. 14(A), FIG. 14(B), FIG. 15, and FIG. 16, is composed of a protrusion 65. The protrusion 65 is provided at a portion on the holding edge part 42 side of the holding cylindrical section 41 of the lens holder 4 and at a respective one of two parts of both of the top left and right sides. At both of the left and right sides of the two protrusions 65, slits (holes or grooves) 66 are respectively provided. As a result, the protrusions 65 each have elasticity thereof in a perpendicular direction or in a substantially perpendicular direction (negative (−) Y-axis direction) with respect to the Z-axis direction. The two protrusions 65 are disposed at both of the left and right sides of the pressing section 70 and the positioning surface 71 of the Z-positioning section of the top lens holder 4.

The protrusion 65 protrudes inside of the lens holder 4 more significantly than an interior face 45 of the holding cylindrical section 41. Both end parts of the protrusion 65 are respectively connected to the holding cylindrical section 41 and the holding edge part 42 via a connecting section 67. That is, the protrusion 65 forms a doubly-supported beam structure by the connecting section 67 at each end part.

The protrusion section 60 and the contact surface 61 of the XY-positioning section, the protrusion section 62 and the contact surface 63 of the rotation positioning section, and the two receiving surfaces 64 and the protrusion 65 of the gap narrowing section are positioned at the positions that surrounds the gravity of the lens 3. The two receiving surfaces 64 and the protrusion 65 of the gap narrowing section are positioned inside of the lens 3 and the lens holder 4 with respect to the protrusion section 60 and the contact surface 61 of the XY-positioning section and the protrusion section 62 and the contact surface 63 of the rotation positioning section.

(Description of Mounting Structure)

At the lens holder 4 and the heat sink member 5, mounting structures are respectively provided. The mounting structures each mount the lens holder 4 that holds the lens 3, to the heat sink member 5, without using a screw.

Figure 5:
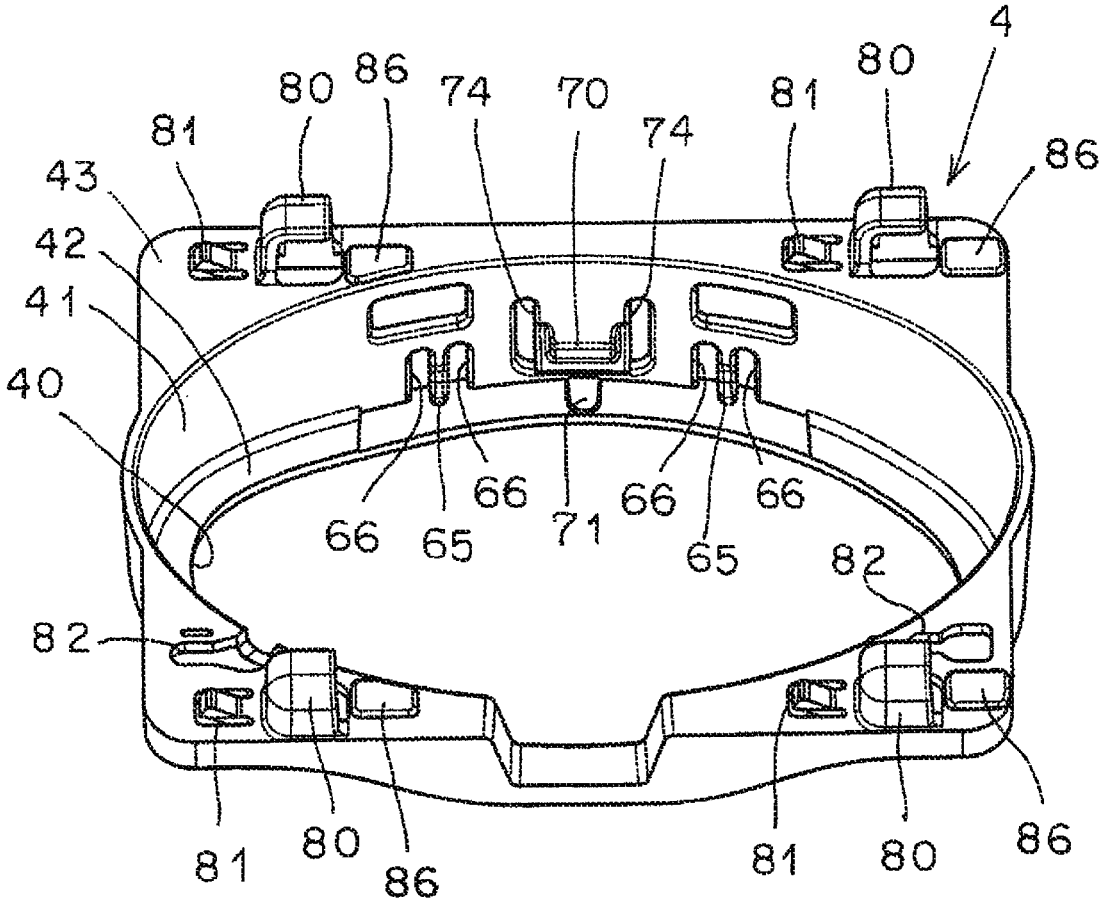
FIG. 5 is a perspective view which is seen from a rear side bottom showing the lens holder of the lamp unit.
Figure 6:
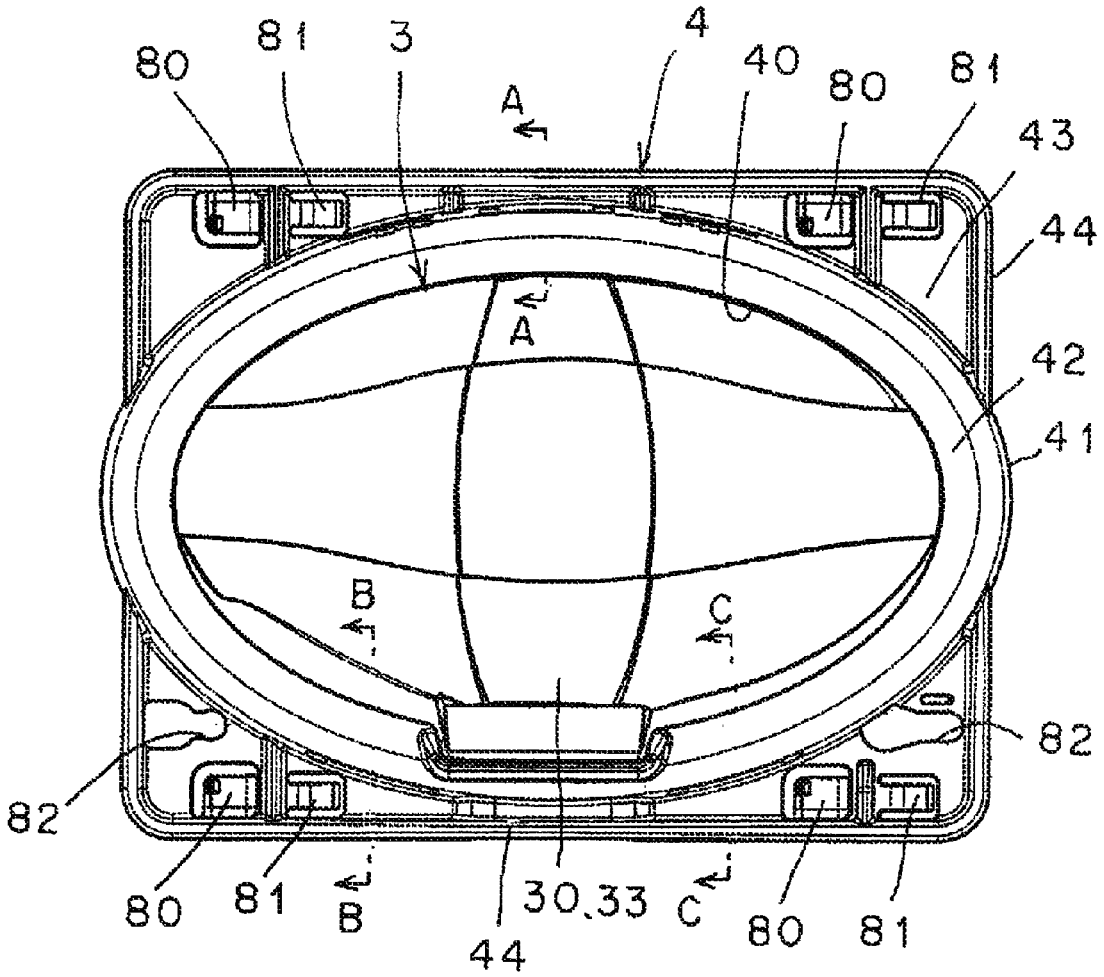
FIG. 6 is a front view showing an assembled state between the lens and the lens holder of the lamp unit.

The mounting structure of the lens holder 4, as shown in FIG. 5 and FIG. 7, is composed of: a mounting hook section 80; a slip-stop section 81; a portion having a positioning hole 82; and a mounting section 86. The mounting hook section 80, the slip-stop section 81, and the mounting section 86 each are provided to be adjacent to one face (a rear face) of a respective one of the four corners of the mounting plate section 43 of the lens holder 4. The positioning hole 82 is provided at a respective one of the two corners at a lower part of the mounting plate section 43 of the lens holder 4.

The mounting structure of the heat sink member 5, as shown in FIG. 1, is composed of a mounting section 83; a portion having a mounting hole section 84; and a positioning pin 85. The mounting section 83 is provided to correspond to the mounting hook section 80 and the mounting section 86 at another face (a front face) of a respective one of the four corners of the vertical plate section 52 of the heat sink member 5. The mounting hole section 84 is provided to correspond to the slip-stop section 81 at a respective one of the four corners of the vertical plate section 52 of the heat sink member 5. The positioning pin 85 is provided to correspond to the positioning hole 82 on another face (the front face) of the two corners of the lower part of the vertical plate section 52 of the heat sink member 5.

(Description of Assembling)

The lamp 1 for vehicles, according to the embodiment, is made of the constituent elements as described above, and hereinafter, a description of assembling will be given.

First, the semiconductor-type light source 2 is set to the light source mounting section 50 of the heat sink member 5. Also, to the mounting section 51 of the heat sink member 5, the light source holder 21 is mounted by way of a screw 22. As a result, the semiconductor-type light source 2 is mounted to the heat sink member 5 via the light source holder 21.

Next, the emission surface 33 of the lens is positioned at a front side, and the holding edge part 42 of the lens holder 4 is positioned at the front side. This lens 3 is inserted into the holding cylindrical section 41 of the lens holder 4 in the Z-axis direction of the reference optical axis, that is, in the Z-axis direction (refer to the solid arrow in FIG. 9(A)). At this time, when the flange section 31 of the lens 3 gets over the pressing section 70 of the Z-positioning section at the lens holder 4 side, the flange section 31 presses the pressing section 70 in the direction indicated by the solid arrow in FIG. 9(B)). Thus, the pressing section 70 elastically deforms in the direction indicated by the solid arrow in FIG. 7(B), that is, in the perpendicular direction or in the substantially perpendicular direction with respect to the Z-axis direction.

In addition, after the flange section 31 has run over the pressing section 70, the pressing section 7—is elastically restored in the direction indicated by the solid arrow in FIG. 9(C), that is, in the perpendicular direction or in the substantially perpendicular direction with respect to the Z-axis direction. Thus, the pressing section 70 presses the receiving-protrusion section 72 of the Z-positioning section at the lens 3 side in the direction indicated by the solid arrow in FIG. 9(C). At this time, a part of the receiving-protrusion section 72 (a part indicated by the dashed line in FIG. 9(C)) cuts into the pressing section 70.

In this manner, the receiving-protrusion section 72 receives the pressing force of the pressing section 70. Thus, the positioning protrusion section 73 of the Z-positioning section at the lens 3 side elastically abuts against the positioning surface 71 of the Z-positioning section at the lens holder 4 side in the direction indicated by the solid arrow in FIG. 9(C), that is, in the Z-axis direction or in the substantial Z-axis direction, due to the pressing force of the pressing section 70 that is received by the receiving-protrusion section 72.

Thus, as shown in FIG. 8 and FIG. 10, the three receiving-protrusion sections 72 and the positioning protrusion section 73 of the Z-positioning section at the lens 3 side are respectively sandwiched between the three pressing section 70 and the positioning surface 71 of the Z-positioning section at the lens holder 4 side, and are fixed in the Z-axis direction by way of the pressing force of the pressing section 70. As a result, the lens 3 is fixed and held on the lens holder 4 in a state in which the position in the Z-axis direction is determined.

In this state, as shown in FIG. 7 and FIG. 14(D), the contact surface 61 of the XY-positioning section at the lens 3 side comes into contact with two parts on the side face of the protrusion section 60 of the XY-positioning section at the lens holder 4 side. In addition, similarly as shown in FIG. 7 and FIG. 14(C), the contact surface 63 of the rotation positioning section at the lens 3 side comes into contact one part on a side face of the protrusion section 62 of the rotation positioning section at the lens holder 4 side. Further, similarly as shown in FIG. 7, FIG. 14(A), and FIG. 14(B), the protrusion 65 of the gap narrowing section at the lens holder 4 side comes into elastic contact with the receiving surface 64 of the gap narrowing section at the lens 3 side in the perpendicular direction or in the substantially perpendicular direction with respect to the Z-axis direction (in the negative (−) Y-axis direction). As a result, the lens 3 is fixed and held to the lens holder 4 in each direction in a state in which the positions in the X-axis direction, in the Y-axis direction, and in a rotation direction (in the rotation direction on the XY-plane about the center of the curved face part of the protrusion section 60) are respectively determined.

Moreover, as indicated by the solid arrow in FIG. 14(A) and FIG. 14(B), the protrusion 65 of the gap narrowing section at the lens holder 4 side comes into elastic contact with the receiving surface 64 of the gap narrowing section at the lens 3 side in the negative (=) Y-axis direction. Thus, as indicated by the solid arrow in FIG. 14(D), the contact surface 61 of the XY-positioning section at the lens 3 side comes into gapless contact with two parts at a side face of the protrusion section 60 of the XY-positioning section at the lens holder 4 side. Also, as indicated by the solid arrow in FIG. 14(C), the contact surface 63 of the rotation positioning section at the lens 3 side comes into gapless contact with one part on a side face of the protrusion section 62 of the rotation positioning section at the lens holder 4 side. In this manner, the lens 3 can be reliably positioned without a backlash at the position that is determined by the XY-positioning section (the positions in the X-axis direction and the Y-axis direction) and the position that is determine by the rotation positioning section (the position in the rotation direction on the XY-plane).

Subsequently, the mounting hook section 80 of the lens holder 4 holding the lens 3 is inserted into the mounting hole section 84 of the heat sink member 5 in an opposite direction to the Z-axis direction. Afterwards, the lens holder 4 holding the lens 3 is slid in the opposite direction to the X-axis direction with respect to the heat sink member 5. Then, the mounting plate section 43 and the mounting hook section 80 of the lens holder 4 sandwich the mounting section 83 of the heat sink member 5. As a result, the lens holder 4 holding the lens 3 is fixed to the heat sink member 5 in the Y-axis direction and the X-axis direction.

Moreover, the slip-stop section 81 of the lens holder 4 comes into elastic contact with an edge of the mounting hole section 84 of the heat sink member 5. As a result, the lens holder 4 holding the lens 3 is fixed to the heat sink member 5 with respect to the X-axis direction. Thus, the lamp 1 for vehicles, according to the embodiment, is assembled.

Description of Functions of Embodiment

The lamp 1 for vehicles, according to the embodiment, is made of the constituent elements as described above, and hereinafter, functions thereof will be described.

In the lamp 1 for vehicles, that is assembled as described above, the light emitting chip of the semiconductor-type light source 2 is lit and emitted. Then, most of the light that is radiated from the light emitting chip is directly made incident into the lens section 30 from the incidence surface 2 of the lens section 30 of the lens 3. At this time, the incident light is controlled to be optically distributed in the incidence surface 32. The incident light having been made incident into the lens section 30 is emitted from the emission surface 33 of the lens section 30. At this time, the emitted light s controlled to be optically distributed in the emission surface 33. The lens light from the lens section 30 is emitted toward the forward direction of the vehicle, as a predetermined light distribution pattern, for example, a low-beam light distribution pattern or a high-beam light distribution pattern.

In addition, most of the light having been radiated from the light emitting chip is directly made incident into the auxiliary lens section from the incidence surface of the auxiliary lens section of the lens 3. At this time, the incident light having been made incident into the auxiliary lens section is reflected on a reflection surface of the auxiliary lens section. At this time, the thus reflected light is controlled to be optically distributed in the reflection surface. The thus reflected light is emitted from the emission surface of the auxiliary lens section. At this time, the emitted light is controlled to be optically distributed in the emission surface. The emitted light from the auxiliary lens section is emitted to the outside of the vehicle, as a predetermined auxiliary light distribution pattern.

Further, a heat which is generated at the light emitting chip of the semiconductor-type light source 2 is radiated to the outside via the heat sink member 5.

Description of Advantageous Effect of Embodiment

The lamp 1 for vehicles, according to the embodiment, is made of the constituent elements and functions as described above, and hereinafter, advantageous effect thereof will be described.

In so far as the lamp 1 for vehicles, according to the embodiment, is concerned, the pressing section 70 of the lens holder 4 presses the lens 3 via the receiving-protrusion section 72 of the lens 3 in one direction of the Z-axis direction of the reference optical axis, that is, in the Z-axis direction or in the substantial Z-axis direction; and the positioning protrusion section 73 of the lens 3 abuts against the positioning surface 71 that is orthogonal to or substantially orthogonal to the Z-axis direction of the reference optical axis of the lens holder 4 by way of the pressing force of the pressing section 70 that is received at the receiving-protrusion section 72. That is, the receiving-protrusion section 72 and the positioning protrusion section 73 of the lens 3 are sandwiched between the pressing section 70 of the lens holder 4 and the positioning surface 71 and then are fixed by way of the pressing force of the pressing section 70. Thus, the lens 3 can be accurately positioned in the Z-axis direction of the reference optical axis with respect to the lens holder 4.

In so far as the lamp 1 for vehicles, according to the embodiment, is concerned, the receiving-protrusion section 72 and the positioning protrusion section 73 that are provided at the flange section 31 of the lens 3 are sandwiched between the pressing section 70 and the positioning surface 71 that are respectively provided at the holding cylindrical section 41 and the holding edge part 42 of the lens holder 4 and then are fixed by way of the pressing force of the pressing section 70. Thus, a pressing part between the receiving-protrusion section 72 and the pressing section 70 and the abutment part between the positioning protrusion section 73 and the positioning surface 71 and dimensions between these two parts are adjusted and managed, and the pressing force of the pressing section 70 can be thereby obtained while the pressing force is constantly adjusted and managed. In particular, in the case of using a lens 3 in which the incidence surface 32 and the emission surface 33 of the lens section 30 each are composed of a free curved face, and concurrently the normal direction in the rear face and the front face of the flange section 31 is not arranged (coincident), holding by a constant pressing force is possible, which is optimal.

Here, a case of the conventional lamp for vehicles, as mentioned previously, will be described. In so far as the conventional lamp for vehicles, as mentioned previously, is concerned, the plugging piece and the engagingly locking claw of the flange section of the lens are held by the holding section such as the pressing hole and the engagingly locking hole. Thus, if the normal direction of the flange section is not arranged, the holding force of the holding section to hold the flange section is dispersed, and the holding force of the holding section is not effectively used. Therefore, there is a need to excessively increase the holding force of the holding section and then cause the holding section to have an excessive strength.

On the other hand, in so far as the lamp 1 for vehicles, according to the embodiment, is concerned, even if the normal direction of the flange section 31 is not arranged, the pressing force of the pressing section 70 can be adjusted and managed by way of the dimensional adjustment and management. Thus, there is no need to excessively increase the pressing force of the pressing section 70 and then cause the pressing section 70 to have an excessive strength. In this manner, strength of the lens holder 4 can be reduced, and parts costs of the lens holder 4 can be reduced.

In so far as the lamp 1 for vehicles, according to the embodiment, is concerned, the pressing section 70 and the positioning surface 71 at the lens holder 4 side oppose to each other; the receiving-protrusion section 72 and the positioning protrusion section 73 at the lens 3 side respectively oppose to the pressing section 70 and the positioning surface 71, and the receiving-protrusion section 72 is provided in a range in which the pressing force of the pressing section 70 is not conveyed to the positioning protrusion section 73. Thus, the pressing force of the pressing section 70 is reliably conveyed to the positioning protrusion section 73 via the receiving-protrusion section 72, and moreover, the positioning protrusion section 73 abuts against the positioning surface 71 with a sufficient pressing force. In this manner, the lens 3 can be accurately positioned in the Z-axis direction of the reference optical axis with respect to the lens holder 4.

In so far as the lamp 1 for vehicles, according to the embodiment, is concerned, as shown in FIG. 9, the receiving-protrusion section 72 is provided at an edge side of the flange section 31 with respect to the positioning protrusion section 73. Thus, when the flange section 31 of the lens 3 gets over the pressing section 70 of the lens section 4 the quantity of elastic deformation of the pressing section 70 by the flange section 31 is reduced. In this manner, damage of the pressing section 70 due to elastic deformation can be reduced as remarkably as possible. Here, if the receiving-protrusion section 72 is provided at an opposite side to the edge side of the flange section 31 with respect to the positioning protrusion section 73, the pressing section 72 is greater in height than the holding cylindrical section 41. Accordingly, the quantity of elastic deformation of the pressing section 70 increases and the possibility of damage then increases. However, in so far as the lamp 1 for vehicles, according to the embodiment, is concerned, the receiving-protrusion section 72 is provided at the edge side of the flange section 31 and thus the pressing section 70 can be smaller in height than the holding cylindrical section 41. Accordingly, the quantity of elastic deformation of the pressing section 70 can be reduced, and the possibility of damage can be reduced as remarkably as possible.

In so far as the lamp 1 for vehicles, according to the embodiment, is concerned, the positioning protrusion section 73 abuts against the positioning surface 71 on a minute plane. Thus, the position in the Z-axis direction of the lens 3 can be determined with a high accuracy. In this manner, the posture of the lens 3 can be maintained and held with a high accuracy. In particular, in the case of using a lens 3 in which the incidence surface 32 and the emission surface 33 of the lens section 30 each are composed of a free curved face, and concurrently the normal direction in the rear face and the front face of the flange section 31 is not arranged (coincident), the position in the Z-axis direction of the lens 3 can be determined with a high accuracy, which is optimal.

In so far as the lamp 1 for vehicles, according to the embodiment, is concerned, the receiving-protrusion section 72 receives the pressing force of the pressing section 72 in a linear manner or in a substantially linear manner along the edge of the flange section 31. Thus, the pressing force of the pressing section 70 per unit of the receiving-protrusion section 72 can be lowered. That is, a surface pressing exerted by the pressing force of the pressing section 70 at the receiving-protrusion section 72 can be reduced. In this manner, durability of the lens 3 is improved, rigidity of the lens 3 can be lowered, and parts costs of the lens 3 can be reduced.

In so far as the lamp 1 for vehicles, according to the embodiment, is concerned, the Z-positioning section made of the pressing section 70, the positioning surface 71, the receiving-protrusion section 72, and the positioning protrusion section 73 holds the lens 3 by way of three-point supporting. Thus, the lens 3 can be held with a high accuracy. In particular, even in a case where the lens 3 is a uniquely shaped lens and moreover the incidence surface 32 and the emission surface 33 each are a lens 3 made of a free curved face, the lens 3 can be held with a high accuracy.

In so far as the lamp 1 for vehicles, according to the embodiment, is concerned, the three points to support the lens 3 of the Z-positioning section is disposed at a position surrounding gravity of the lens 3. Thus, the lens 3 can be stably mounted to the heat sink member 5 via the lens holder 4 against vibration of the vehicle.

In so far as the lamp 1 for vehicles, according to the embodiment, is concerned, the protrusion 65 of the gap narrowing section at the lens holder 4 side comes into elastic contact with the receiving surface 64 of the gap narrowing section at the lens 3 side in the negative (−) Y-axis direction. Thus, it is possible to narrow a gap between two parts, the contact surface 61 of the XY-positioning section at the lens 3 side and a side face of the protrusion section 60 of the rotation positioning section at the lens holder 4 side. Also, it is possible to narrow a gap between the contact surface 63 of the rotation positioning section at the lens 3 side and one of the side faces of the protrusion section 62 of the rotation positioning section at the lens holder 4 side. In this manner, the lens 3 can be reliably positioned without a backlash at the position that is determined by the XY-positioning section (the position in the X-axis direction and the Y-axis direction) and the position that is determined by the rotation positioning section (the position in the rotation direction on the XY-plane).

In so far as the lamp 1 for vehicles, according to the embodiment, is concerned, slits 66 are respectively provided at both sides of the protrusion 65. Thus, both end parts of the protrusion 65 are connected to the lens holder 4 by way of the connecting section 67, and the protrusion 65 forms a doubly supported beam structure. As a result, the rigidity in the connecting sections 67 at both end parts of the protrusion 65 can be lowered and thus the protrusion 65 can be employed as a spring structure having elasticity thereof in the negative (−) Y-axis direction. In this manner, in a state in which the entire rigidity of the lens holder 4 is maintained without lowering, dimensional tolerances of the lens 3 and the lens holder 4 can be absorbed. That is, the lens 3 can be reliably held on the lens holder 4 without a backlash.

Here, a case of the conventional lamp for vehicles, as mentioned previously, will be described. In so far as the conventional lamp for vehicles, as mentioned previously, is concerned, the lens is positioned at the lens holder in a state in which the lens is caused to interfere with the positioning protrusion (that is, in a state in which the lens holder is distorted). Thus, due to the dimensional tolerances of the lens and the lens holder, there may be a case in which the distortion of the lens holder increases, the lens holder is damaged, or the assembling load increases. If the rigidity of the lens holder is lowered in order to avoid this abnormality, there may be a case in which the holding force against vibration or impact lowers, making it difficult to stably hold the lens.

On the other hand, in so far as the lamp 1 for vehicles, according to the embodiment, is concerned, the sits 66 are respectively provided at both sides of the protrusion 65, the rigidity in the connection sections 67 at both end parts of the protrusion 65 is lowered, and the protrusion 65 is obtained as a spring structure having elasticity thereof in the negative (−) Y-axis direction. Thus, while the entire rigidity of the lens holder 4 is maintained, the dimensional tolerances of the lens 3 and the lens holder 4 can be absorbed. In this manner, distortion and assembling load of the lens holder 4 can be adjusted.

In so far as the lamp 1 for vehicles, according to the embodiment, is concerned, the protrusion 65 protrudes to the inside more significantly than the interior face 45 of the holding cylindrical section 41 of the lens holder 4 and thus the protrusion 65 reliably comes into elastic contact with the receiving surface 64 while they interfere with each other.

In so far as the lamp 1 for vehicles, according to the embodiment, is concerned, the receiving surface 64 is provided in the X-axis direction, that is, so as to be orthogonal to or substantially orthogonal to the Y-axis direction. Thus, the receiving surface 64 is capable of reliably receiving the elastic force in the negative (−) Y-axis direction of the protrusion 65. As a result, the elastic force of the protrusion 65 can be respectively conveyed to the protrusion section 60 and the contact surface 61 of the XY-positioning section and the protrusion section 62 and the contact surface 63 of rotation positioning section. In this manner, a gap (backlash) between the protrusion sections 60, 62 and the contact surfaces 61, 63 can be reliably eliminated.

In so far as the lamp 1 for vehicles, according to the embodiment, is concerned, the two receiving surfaces 64 of the gap narrowing section and the protrusion 65 are disposed inside of the lens 3 and the lens holder 4 with respect to the protrusion section 60 and the contact surface 61 of the XY-positioning section and the protrusion section 62 and the contact surface 63 of the rotation positioning section. Thus, the elastic force of the protrusion 65 can be respectively reliably conveyed in a well-balanced manner to the protrusion section 60 and the contact surface 61 of the XY-positioning section and the protrusion section 62 and the contact surface 63 of the rotation positioning section. In this manner, a gap (backlash) between the protrusion sections 60, 62 and the contact surfaces 61, 63 can be reliably eliminated.

In so far as the lamp 1 for vehicles, according to the embodiment, is concerned, the two receiving surfaces 64 and the protrusion 65 of the gap narrowing section are provided at the upper part of the lens 3 and at the upper part of the lens holder 4, whereas the contact surfaces 61, 63 of the XY-positioning section are respectively provided at the lower part of the lens 3 and the lower part of the lens holder 4, and the contact surface 63 and the protrusion section 62 of the rotation positioning section are respectively provided at the lower part of the lens 3 and at the lower part of the lens holder 4. Thus, elasticity of the protrusion 65 acts in a gravitational direction; and therefore a gap (a backlash) between the protrusion sections 60, 62 and the contact surfaces 61, 63 can be reliably eliminated.

Description of Modification Example 1

Figure 11:
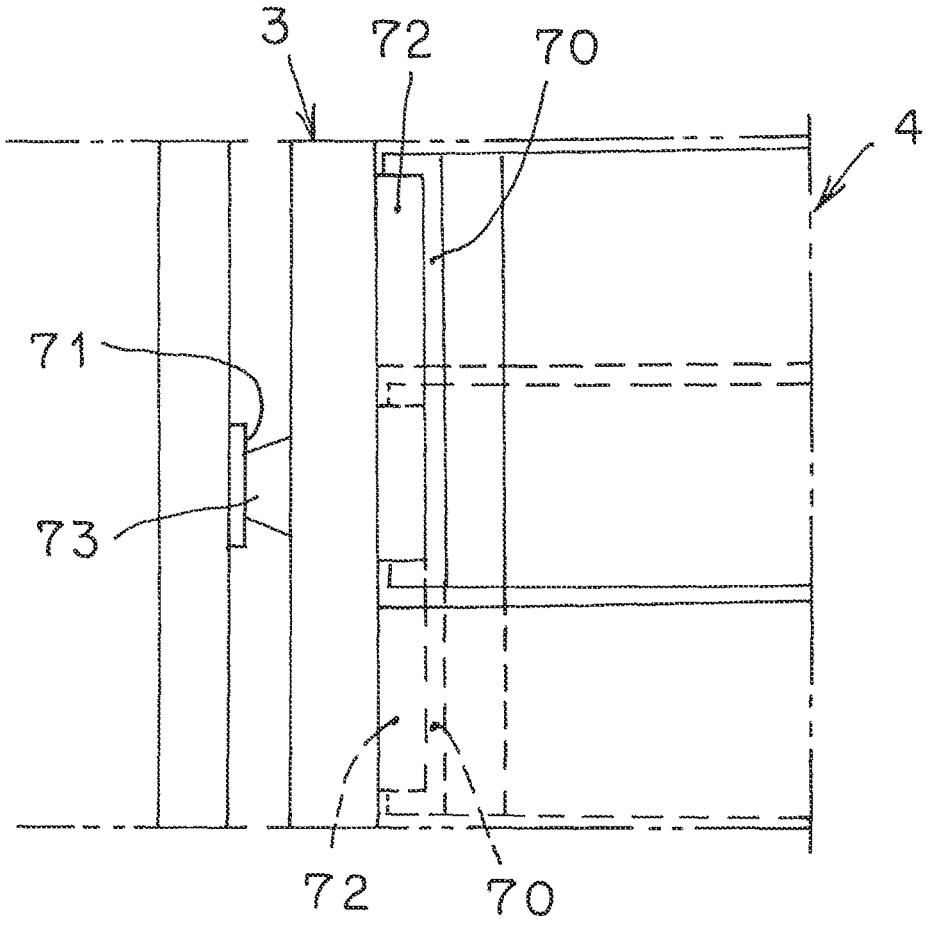
FIG. 11 is a partially enlarged explanatory view showing a modification example of a lamp for vehicles, according to the present invention (a view corresponding to FIG. 10).

FIG. 11 shows modification example 1 of the lamp for vehicles, according to the present invention. Hereinafter, the lamp for vehicles, in modification example 1 will be described. In the figure, the same reference numerals in FIG. 1 to FIG. 10 designate the same constituent elements.

The lamp 1 for vehicles, of the embodiment, as shown in FIG. 10, aligns the center of the receiving-protrusion section 72 that is provided along the edge of the flange section 31, to the positioning protrusion section 73. On the other hand, the lamp for vehicles, of modification example 1, displaces the center of the receiving-protrusion section 72 along the edge of the flange section 31 with respect to the positioning protrusion section 73. Incidentally, it is preferable that the displacement quantity of the receiving-protrusion section 72 be in the range in which the pressing force of the pressing section 70 is conveyed to the positioning protrusion section 73.

Description of Modification Example 2

Figure 12:
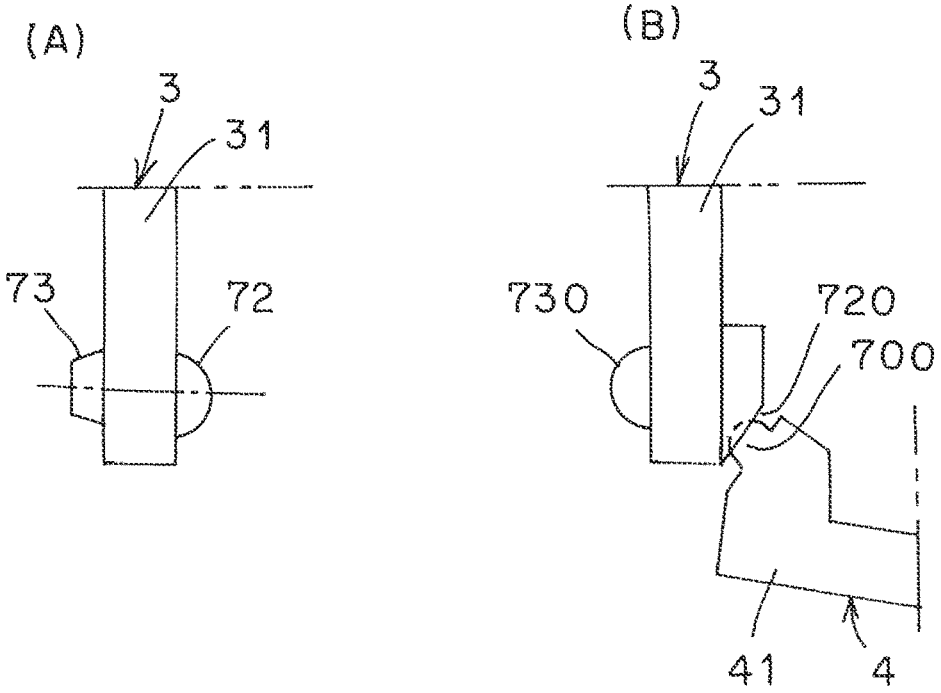
FIG. 12 is a partially enlarged explanatory view showing a modification example of the lamp for vehicles, according to the present invention (a view corresponding to FIG. 9).

FIG. 12(A) shows modification example 2 of the lamp for vehicles, according to the present invention. Hereinafter, the lamp for vehicles, in modification example 2, will be described. In the figure, the same reference numerals in FIG. 1 to FIG. 11 designate the same constituent elements.

The lamp 1 for vehicles, of the embodiment, as shown in FIG. 8 and FIG. 9, provides the receiving-protrusion section 72 at the edge side of the flange section 31 with respect to the positioning protrusion section 73. On the other hand, the lamp for vehicles, of modification example 2, provides the receiving-protrusion section 72 to correspond to the positioning protrusion section 73. Alternatively, the receiving-protrusion section 72 may be provided at an opposite side to the edge side of the flange section 31 with respect to the positioning protrusion section 73. Incidentally, it is preferable that the position at which the receiving-protrusion section 72 is to be provided with respect to the positioning protrusion section 73 be in the range in which the pressing force of the pressing section 70 is conveyed to the positioning protrusion section 73.

Description of Modification Example 3

FIG. 12(B) shows modification example 3 of the lamp for vehicles, according to the present invention. Hereinafter, the lamp for vehicles, in modification example 3, will be described. In the figure, the same reference numerals in FIG. 1 to FIG. 11 and FIG. 12(A) designate the same constituent elements.

The lamp 1 for vehicles, of the embodiment, as shown in FIG. 8 and FIG. 9, is configured so that, with the pressing force 70 being a plane and the receiving-protrusion section 72 being a curved face, the receiving-protrusion section 72 receives the pressing force of the pressing section 70 in the linear manner or in the substantially linear manner along the edge of the flange section 31. On the other hand, the lamp for vehicles, of modification example 3, is configured so that, with a pressing section 700 being a curved face and a receiving-protrusion section being a receiving protrusion section 720, the receiving-protrusion section 720 receives the pressing force of the pressing section 700 in the linear manner or in the substantially linear manner along the edge of the flange section 31.

In so far as the lamp 1 for vehicles, of the embodiment, is concerned, as shown in FIG. 8 and FIG. 9, an apex of the positioning protrusion section 73 is made of a minute plane which is orthogonal to or substantially orthogonal to the reference optical axis Z, and the positioning protrusion section 73 abuts against the positioning surface 71 on the minute plane by way of the pressing force of the pressing section 70 that is received at the receiving-protrusion section 72. On the other hand, in so far as the lamp for vehicle, of modification example 3, is concerned, the positioning protrusion section 730 is made of a hemispheric shape, and the positioning protrusion section 730 abuts against the positioning surface 71 at a point by way of the pressing force of the pressing section 70 that is received at the receiving-protrusion section 72.

Description of Examples Other than Embodiment and Modification Examples

The embodiment and modification examples are examples in which a low-beam light distribution pattern and a high-beam light distribution pattern are used in headlamps for vehicles such as a headlamp to emit light toward the forward direction of the vehicle. However, in the present invention, these light distribution patterns can be used in lamps for vehicles other than headlamps for vehicles such as headlamps, for example, an auxiliary headlamp such as a fog lamp or any other lamp for vehicles such as an additional lamp, a tail lamp, a stop lamp, or a tail stop lamp.

In addition, in the embodiment and modification examples, the semiconductor-type light source 2 is used as a light source. However, in the present invention, as a light source, light sources other than the semiconductor-type light source 2 (light emitting bodies, light emitting elements, light emitting members, light emitting devices) may be used.

Further, the Z-positioning section made of the pressing section 70, the positioning surface 71, receiving-protrusion section 72, and the positioning protrusion section 73 is provided at three parts of the lens 3 and the lens holder 4. However, in the present invention, the Z-positioning section made of the pressing section 70, the positioning surface 71, receiving-protrusion section 72, and the positioning protrusion section 73 may be provided at least at one part of the lens 3 and the lens holder 4.

Figure 13:
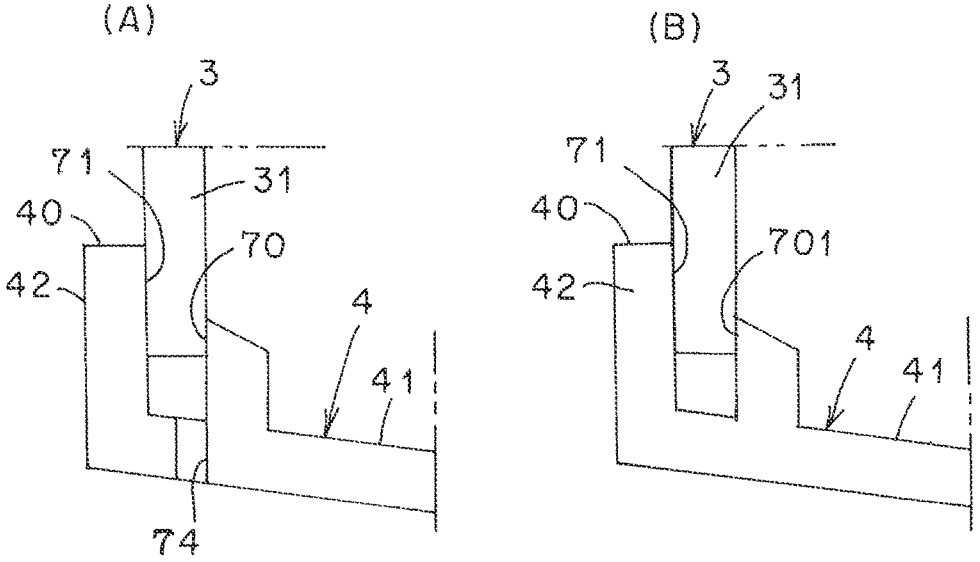
FIG. 13 is a partially enlarged explanatory view of a structure of a general Z-positioning section (a view corresponding to FIG. 9).

In this case, as shown in FIG. 13(A), a lens 3 in which the receiving-protrusion section 72 and the positioning protrusion section 73 are not provided at one part or two parts of the flange section 31 is used in place of the above lens. Alternatively, as shown in FIG. 13(B), a lens 3 in which the receiving-protrusion section 72 and the positioning protrusion section 73 are not provided at one part or two parts of the flange section 31; and a lens holder 4 having a pressing section 701 which does not have elasticity thereof and in which a cutout 74 is not provided at one part or two parts of the holding cylindrical section 41, are used in place of the above lens and lens holder.

Furthermore, in the embodiment and modification examples, the receiving section and the positioning abutment section of the positioning section is composed of the receiving-protrusion sections 72, 720 and the positioning protrusion section 73, 730, each of which forms a protrusion shape. However, in the present invention, the receiving section and the positioning abutment section of the positioning section may be composed of anything but the receiving-protrusion sections 72, 720 and the positioning protrusion section 73, 730, each of which forms a protrusion shape.

Further, in the embodiment, the receiving surface 64 and the contact surfaces 61, 63 are provided at the lens 3, and the protrusion 65 and the protrusion sections 60, 62 are provided at the lens holder 4. However, in the present invention, it may be that the protrusion and the protrusion section are provided at the lens, and the receiving surface and the contact surface are provided on the lens holder, or alternatively, it may be that the receiving surface, the contact surface and the protrusion, and the protrusion section are respectively provided at their appropriate positions of the lens, and the protrusion, the protrusion section and the receiving surface, and the contact surface are respectively provided at their appropriate positions of the lens holder.

Furthermore, in the embodiment, the protrusion 65 and the receiving surface 64 of the gap narrowing section are provided by two. However, the protrusion and the receiving surface of the gap narrowing section may be provided solely or by three or more.

Still furthermore, in the embodiment, the positioning section is made of the protrusion section 60 and the contact surface 61 of the XY-positioning section; and the protrusion section 62 and contact surface 63 of the rotation positioning section. However, in the present invention, the positioning section may be made of one protrusion section and one contact surface or may be made of three or more protrusion sections and contact surfaces.

Yet furthermore, in the embodiment, the positioning section is composed of the protrusion sections 60, 62 and the contact surfaces 61, 63. However, in the present invention, the positioning section may be composed of anything but the protrusion sections 60, 62 and the contact surfaces 61, 63.

Furthermore, in the embodiment, slits 66 are provided at both of the left and right sides of the protrusion 65 so as to cause the protrusion 65 to have elasticity thereof. However, in the embodiment, a configuration may be employed so that opening sections such as U-shaped holes, grooves, or cutouts other than these slits 66 are provided in a close vicinity of the protrusion so as to cause the protrusion to have elasticity thereof.

DESCRIPTION OF REFERENCE NUMERALS

1 Lamp for vehicles
2 Semiconductor-type light source
20 Board
21 Light source holder
22 Screw
3 Lens
30 Lens section
31 Flange section
32 Incidence surface
33 Emission surface
4 Lens holder
40 Opening section
41 Holding cylindrical section
42 Holding edge part
43 Mounting plate section
44 Reinforcement rib section
5 Heat sink member (mounting member)
50 Light source mounting section
51 Light source holder mounting section
52 Vertical plate section
53 Fin section
54 Recessed section
60, 62 Protrusion sections
61, 63 Contact surfaces
64 Receiving surface
65 Protrusion
66 Slit
70, 700 Pressing sections
71 Positioning surface
72, 720 Receiving-protrusion sections
73, 730 Positioning protrusion sections
74 Cutout
80 Mounting hook section
81 Slip stop section
82 Positioning hole
83 Mounting section
84 Mounting hole section
85 Positioning pin
86 Mounting section
XX-axis
YY-axis
ZZ-axis (reference optical axis of lens)

The invention claimed is:

1. A lamp for vehicles, comprising:
a light source;
a lens to emit light from the light source to an outside;
a lens holder to hold the lens; and
a mounting member to which the light source and the lens holder are mounted,
wherein, at the lens and the lens holder, positioning sections to position the lens in a reference optical axis direction of the lens are respectively provided,
wherein the positioning sections of the lens holder each comprises:
a pressing section to press the lens in the reference optical axis direction by a pressing force caused by elastic restoration of the pressing section; and
a positioning surface which is orthogonal to or substantially orthogonal to a z-axis direction of the reference optical axis direction and opposite to the pressing section, the pressing section and the positioning surface being arranged to sandwich the positioning sections of the lens therebetween in the reference optical axis direction due to the pressing force, and
wherein the positioning sections of the lens each comprise:
a receiving section to receive the pressing force of the pressing section when the positioning section of the lens is sandwiched between the pressing section and the positioning surface; and
a positioning abutment section provided oppositely to the receiving section to abut against the positioning surface by way of the pressing force that the receiving section receives when the positioning sections of the lens is sandwiched between the pressing section and the positioning surface.

2. The lamp for vehicles, according to claim 1,
wherein the lens comprises: a lens section; and a flange section which is provided at a peripheral edge part of the lens section,
wherein the lens holder comprises:
a holding cylindrical section; and
a holding edge part which is provided inside the cylindrical section from an end of the holding cylindrical section, and includes an opening section in which the lens section is disposed at a center part,
wherein the pressing section is provided on an inner circumferential face of the holding cylindrical section,
wherein the positioning surface is provided on an inner circumferential face of the holding edge part so as to oppose to the pressing section,
wherein the positioning abutment section is provided on a surface which opposes the positioning surface, of the flange section,
wherein the receiving section is provided on a surface which opposes the pressing section, of the flange section, and in a range in which the pressing force of the pressing section is conveyed to the positioning abutment section.

3. The lamp for vehicles, according to claim 2,
wherein the receiving section is provided at an edge side of the flange section with respect to the positioning abutment section.

4. The lamp for vehicles, according to claim 2,
wherein the positioning abutment section forms a shape of a protrusion section to abut against the positioning surface on a minute plane, and
wherein the receiving section forms a shape of a protrusion section to receive the pressing force of the pressing section in a linear shape or in a substantially linear shape along an edge of the flange section.

5. A lamp for vehicles, comprising:
a light source;

a lens to emit light from the light source to an outside;

a lens holder to hold the lens; and a mounting member to which the light source and the lens holder are mounted, wherein, at the lens and the lens holder, a positioning section to determine a position of the lens and a gap narrowing section to narrow a gap of the positioning section are respectively provided, wherein the gap narrowing section comprises:

a receiving surface which is provided at the lens; and a protrusion which is provided at the lens holder to come into contact with the receiving surface, and wherein an opening section is provided at the lens holder adjacently to the protrusion so that the protrusion is of a doubly-supported beam structure having elasticity, the ends of the protrusion are connected respectively to a cylindrical section and an edge part of the lens holder, and is arranged to come into the elastic contact with the receiving surface to narrow the gap of the positioning section.

6. The lamp for vehicles, according to claim 5, wherein the positioning section comprises an XY-positioning section and a rotation positioning section, and wherein the gap narrowing section has at least one set of the receiving surface and the protrusion, and is disposed inside with respect to the XY-positioning section and the rotation positioning section.

7. The lamp for vehicles, according to claim 5, wherein the positioning section is provided at a respective one of a lower part of the lens and a lower part of the lens holder, and wherein the gap narrowing section is provided at a respective one of an upper part of the lens and an upper part of the lens holder.

* * * * *